US009094743B2

(12) United States Patent
Bokaemper et al.

(10) Patent No.: US 9,094,743 B2
(45) Date of Patent: Jul. 28, 2015

(54) ACOUSTIC TRANSDUCERS

(71) Applicant: Emo Labs, Inc., Waltham, MA (US)

(72) Inventors: Stefan Bokaemper, Newton, MA (US); Terrence Keith Jones, Sharon, MA (US)

(73) Assignee: Emo Labs, Inc., Wellesley, MA (US)

( * ) Notice: Subject to any disclaimer, the term of this patent is extended or adjusted under 35 U.S.C. 154(b) by 0 days.

(21) Appl. No.: 14/212,317

(22) Filed: Mar. 14, 2014

(65) Prior Publication Data

US 2014/0262599 A1 Sep. 18, 2014

Related U.S. Application Data

(60) Provisional application No. 61/791,355, filed on Mar. 15, 2013.

(51) Int. Cl.

| | |
|---|---|
| ***H04R 7/04*** | (2006.01) |
| ***H04R 1/22*** | (2006.01) |
| ***H04R 1/00*** | (2006.01) |
| ***H04R 5/00*** | (2006.01) |
| ***H04R 17/00*** | (2006.01) |
| ***H04R 7/12*** | (2006.01) |
| ***H04R 7/16*** | (2006.01) |
| ***H04R 9/06*** | (2006.01) |

(Continued)

(52) U.S. Cl.

CPC .. *H04R 1/00* (2013.01); *H04R 1/22* (2013.01); *H04R 5/00* (2013.01); *H04R 7/045* (2013.01); *H04R 7/12* (2013.01); *H04R 7/16* (2013.01); *H04R 9/066* (2013.01); *H04R 17/00* (2013.01); *H04R 17/005* (2013.01)

(58) Field of Classification Search

CPC ..... G10K 13/00; G10K 9/121; G10K 9/122; G10K 9/125; G10K 9/22; H04R 1/20; H04R 1/22; H04R 1/24; H04R 17/10

USPC ..... 181/173, 167, 161, 154, 166; 381/152, 381/162, 163, 191, 423, 426, 431, 190, 395, 381/388, 333

See application file for complete search history.

(56) References Cited

U.S. PATENT DOCUMENTS

| | | | |
|---|---|---|---|
| 2,862,069 | A | 11/1958 | Marchand et al. |
| 2,895,062 | A | 7/1959 | Abbott |
| 3,057,961 | A | 10/1962 | Turner |

(Continued)

FOREIGN PATENT DOCUMENTS

| | | | |
|---|---|---|---|
| CA | 2396260 | A1 | 7/2001 |
| CA | 2610483 | A1 | 12/2006 |

(Continued)

OTHER PUBLICATIONS

International Search Report and Written Opinion mailed on Jul. 15, 2014, for International Patent Application No. PCT/US2014/028388, filed Mar. 14, 2014 (15 pages).

(Continued)

*Primary Examiner* — Edgardo San Martin

(74) *Attorney, Agent, or Firm* — Brown Rudnick LLP

(57) ABSTRACT

The invention generally relates to acoustic transducers. In certain aspects, the acoustic transducer includes a diaphragm and an actuator coupled to the diaphragm to cause movement of the diaphragm. The transducer includes a member that limits bending of the diaphragm.

14 Claims, 32 Drawing Sheets

(51) Int. Cl.
*H04R 7/00* (2006.01)
*H04R 1/20* (2006.01)

(56) References Cited

U.S. PATENT DOCUMENTS 3,093,710 A 6/1963 Ten Eyck
3,509,387 A 4/1970 Davies et al.
3,544,201 A 12/1970 Fowler et al.
4,028,504 A 6/1977 Massa
4,047,060 A 9/1977 Schafft
4,056,742 A 11/1977 Tibbetts
4,088,915 A 5/1978 Kodama
4,140,203 A 2/1979 Niguchi et al.
4,170,742 A 10/1979 Itagaki et al.
4,181,865 A 1/1980 Kohyama
4,186,323 A 1/1980 Cragg et al.
4,198,550 A 4/1980 Matsuda et al.
4,216,401 A 8/1980 Wagner
4,241,313 A 12/1980 Takehara
4,291,205 A 9/1981 Kamon et al.
4,297,185 A 10/1981 Chevreux et al.
4,315,557 A 2/1982 Nakaya et al.
4,352,961 A 10/1982 Kumada et al.
4,454,386 A 6/1984 Koyano
4,503,564 A 3/1985 Edelman et al.
4,571,553 A 2/1986 Yokoyama
4,573,189 A 2/1986 Hall
4,578,613 A 3/1986 Posthuma de Boer et al.
4,593,160 A 6/1986 Nakamura
4,607,145 A 8/1986 Ravinet et al.
4,618,814 A 10/1986 Kato et al.
4,625,138 A 11/1986 Ballato
4,625,259 A 11/1986 Krechmer et al.
4,638,207 A 1/1987 Radice
4,680,800 A 7/1987 Bank et al.
4,742,499 A * 5/1988 Butler ..... 367/155
4,751,419 A 6/1988 Takahata
4,807,294 A 2/1989 Iwata et al.
4,812,698 A 3/1989 Chida et al.
4,847,904 A 7/1989 McShane
4,864,624 A 9/1989 Tichy
4,899,390 A 2/1990 Takewa et al.
4,969,197 A 11/1990 Takaya
4,979,219 A 12/1990 Lin
4,992,692 A 2/1991 Dias
4,997,058 A 3/1991 Bertagni
5,031,222 A 7/1991 Takaya
5,081,683 A 1/1992 Torgeson
5,115,472 A 5/1992 Park et al.
5,193,119 A 3/1993 Tontini et al.
5,265,165 A 11/1993 Rauch
5,283,835 A 2/1994 Athanas
5,368,917 A 11/1994 Rehfeld et al.
5,388,160 A 2/1995 Hashimoto et al.
5,392,000 A 2/1995 Gillig
5,428,832 A 6/1995 Nohara et al.
5,473,214 A 12/1995 Hildebrand
5,524,058 A 6/1996 Moseley
5,526,421 A 6/1996 Berger et al.
5,575,827 A 11/1996 Piniecki
5,608,282 A 3/1997 Wilber et al.
5,615,270 A 3/1997 Miller et al.
5,638,454 A 6/1997 Jones et al.
5,638,456 A 6/1997 Conley et al.
5,642,332 A 6/1997 Chang et al.
5,652,801 A 7/1997 Paddock
5,676,612 A 10/1997 Schellekens et al.
5,684,689 A 11/1997 Hahn
5,684,884 A 11/1997 Nakaya et al.
5,705,878 A 1/1998 Lewis et al.
5,711,058 A 1/1998 Frey
5,727,076 A * 3/1998 Paddock ..... 381/190
5,736,808 A 4/1998 Szilagyi et al.
5,751,827 A 5/1998 Takahashi
5,767,612 A 6/1998 Takeuchi et al.
5,773,102 A 6/1998 Rehfeld
5,780,958 A 7/1998 Strugach et al.
5,802,195 A 9/1998 Regan et al.
5,825,902 A 10/1998 Fujishima
5,828,768 A 10/1998 Eatwell et al.
5,856,956 A 1/1999 Toki
5,867,302 A 2/1999 Fleming
5,901,231 A 5/1999 Parrella et al.
5,965,249 A 10/1999 Sutton et al.
5,973,441 A 10/1999 Lo et al.
5,977,688 A 11/1999 Utsunomiya et al.
6,003,766 A 12/1999 Azima et al.
6,023,123 A 2/2000 Petiet
6,028,389 A 2/2000 Bernstein
6,031,926 A 2/2000 Azima et al.
6,058,196 A 5/2000 Heron
6,060,811 A 5/2000 Fox et al.
6,061,461 A * 5/2000 Paddock ..... 381/424
6,064,746 A 5/2000 Nakamura et al.
6,144,746 A 11/2000 Azima et al.
6,151,402 A 11/2000 Azima et al.
6,181,797 B1 1/2001 Parrella et al.
6,188,775 B1 2/2001 Azima et al.
6,195,440 B1 2/2001 Warnaka et al.
6,198,831 B1 3/2001 Azima et al.
6,215,881 B1 4/2001 Azima et al.
6,215,882 B1 4/2001 Heron
6,215,884 B1 4/2001 Parrella et al.
6,218,766 B1 4/2001 Warnaka et al.
6,243,473 B1 6/2001 Azima et al.
6,247,551 B1 6/2001 Heron
6,278,790 B1 8/2001 Davis et al.
6,294,859 B1 9/2001 Jaenker
6,386,315 B1 * 5/2002 Roy et al. ..... 181/150
6,427,017 B1 7/2002 Toki
6,437,485 B1 8/2002 Johansson
6,472,797 B1 10/2002 Kishimoto
6,504,286 B1 1/2003 Porat et al.
6,522,460 B2 2/2003 Bonnedal et al.
6,522,760 B2 2/2003 Azima et al.
6,570,299 B2 5/2003 Takeshima et al.
6,617,765 B1 9/2003 Lagier et al.
6,708,797 B2 3/2004 Long et al.
6,720,708 B2 4/2004 Athanas
6,720,709 B2 4/2004 Porat et al.
6,721,436 B1 * 4/2004 Bertagni et al. ..... 381/423
6,785,393 B2 8/2004 Lipponen et al.
6,797,396 B1 9/2004 Liu et al.
6,819,769 B1 * 11/2004 Zimmermann ..... 381/152
6,844,657 B2 1/2005 Miller et al.
6,845,166 B2 1/2005 Hara et al.
7,009,326 B1 3/2006 Matsuo et al.
7,010,143 B2 3/2006 Kam
7,015,624 B1 3/2006 Su et al.
7,020,302 B2 3/2006 Konishi et al.
7,038,356 B2 5/2006 Athanas
7,039,206 B2 5/2006 Mellow
7,050,600 B2 5/2006 Saiki et al.
7,103,190 B2 * 9/2006 Johnson et al. ..... 381/152
7,120,263 B2 10/2006 Azima et al.
7,151,837 B2 12/2006 Bank et al.
7,174,025 B2 2/2007 Azima et al.
7,194,098 B2 3/2007 Azima et al.
7,212,648 B2 5/2007 Saiki et a
7,236,602 B2 6/2007 Gustavsson
7,274,855 B2 9/2007 Nevo et al.
7,339,736 B2 3/2008 Trapani et al.
7,536,211 B2 5/2009 Saiki et al.
7,565,949 B2 7/2009 Tojo
7,583,811 B2 9/2009 Wada
7,639,826 B1 * 12/2009 Azima et al. ..... 381/152
7,788,808 B1 9/2010 Ptak
7,792,319 B2 9/2010 Kimura et al.
7,884,529 B2 2/2011 Johnson et al.
7,889,601 B2 2/2011 Goodmote et al.
7,903,091 B2 3/2011 Lee et al.
8,033,674 B1 10/2011 Coleman et al.
8,068,635 B2 11/2011 Carlson et al.
8,189,851 B2 5/2012 Booth et al.

(56) References Cited

U.S. PATENT DOCUMENTS

| | | | | |
|---|---|---|---|---|
| 8,395,371 | B2 | 3/2013 | Govil | |
| 8,699,729 | B2 * | 4/2014 | Fathollahi | 381/182 |
| 8,798,310 | B2 * | 8/2014 | Booth et al. | 381/426 |
| 2001/0026626 | A1 | 10/2001 | Athanas | |
| 2001/0038701 | A1 | 11/2001 | Corynen | |
| 2001/0052627 | A1 | 12/2001 | Takahashi et al. | |
| 2002/0001392 | A1 | 1/2002 | Isono et al. | |
| 2002/0044668 | A1 | 4/2002 | Azima | |
| 2002/0153194 | A1 | 10/2002 | Pocock et al. | |
| 2003/0161479 | A1 | 8/2003 | Yang et al. | |
| 2004/0037441 | A1 | 2/2004 | Konishi et al. | |
| 2004/0189151 | A1 | 9/2004 | Athanas | |
| 2004/0228501 | A1 | 11/2004 | Saiki et al. | |
| 2004/0240687 | A1 * | 12/2004 | Graetz | 381/152 |
| 2005/0053257 | A1 | 3/2005 | Johnson et al. | |
| 2005/0069430 | A1 | 3/2005 | Sugahara | |
| 2005/0180592 | A1 | 8/2005 | Miura | |
| 2005/0232435 | A1 | 10/2005 | Stothers et al. | |
| 2005/0288039 | A1 | 12/2005 | Liou | |
| 2006/0066803 | A1 | 3/2006 | Aylward et al. | |
| 2006/0269087 | A1 | 11/2006 | Johnson et al. | |
| 2006/0290236 | A1 | 12/2006 | Ikehashi | |
| 2007/0000720 | A1 | 1/2007 | Noro et al. | |
| 2007/0003100 | A1 | 1/2007 | Liu | |
| 2007/0007859 | A1 | 1/2007 | Weber | |
| 2007/0092088 | A1 | 4/2007 | Chang | |
| 2007/0133837 | A1 | 6/2007 | Suzuki et al. | |
| 2007/0165887 | A1 * | 7/2007 | Shin et al. | 381/152 |
| 2007/0223714 | A1 | 9/2007 | Nishikawa | |
| 2007/0243364 | A1 | 10/2007 | Maekawa et al. | |
| 2007/0260019 | A1 | 11/2007 | Ohme et al. | |
| 2007/0297620 | A1 | 12/2007 | Choy | |
| 2008/0007829 | A1 | 1/2008 | Mizushima et al. | |
| 2008/0138541 | A1 | 6/2008 | Moto et al. | |
| 2008/0138543 | A1 | 6/2008 | Hoshino et al. | |
| 2008/0273720 | A1 | 11/2008 | Johnson et al. | |
| 2009/0136690 | A1 | 5/2009 | Sasada | |
| 2009/0190791 | A1 | 7/2009 | Unruh et al. | |
| 2009/0200896 | A1 | 8/2009 | Morris et al. | |
| 2009/0285431 | A1 | 11/2009 | Carlson et al. | |
| 2009/0317592 | A1 | 12/2009 | Yoshitomi et al. | |
| 2010/0111351 | A1 * | 5/2010 | Berkhoff | 381/396 |
| 2010/0224437 | A1 | 9/2010 | Booth et al. | |
| 2010/0322455 | A1 | 12/2010 | Carlson | |
| 2011/0026757 | A1 | 2/2011 | Takahashi et al. | |
| 2011/0033074 | A1 | 2/2011 | Chang et al. | |
| 2011/0044476 | A1 | 2/2011 | Burlingame et al. | |
| 2011/0249858 | A1 | 10/2011 | Lee et al. | |
| 2011/0274283 | A1 | 11/2011 | Athanas | |
| 2012/0186903 | A1 | 7/2012 | Booth et al. | |
| 2014/0079255 | A1 * | 3/2014 | Ando | 381/190 |

FOREIGN PATENT DOCUMENTS

| | | | |
|---|---|---|---|
| EP | 1395083 | A2 | 3/2004 |
| FR | 2649575 | A1 | 1/1991 |
| GB | 1369241 | A | 10/1974 |
| JP | 52045923 | | 4/1977 |
| JP | 5615182 | | 7/1979 |
| JP | 57181298 | | 11/1982 |
| JP | 58034699 | | 3/1983 |
| JP | 58182999 | | 10/1983 |
| JP | 63176098 | | 7/1988 |
| JP | 63176099 | | 7/1988 |
| JP | 63250995 | | 10/1988 |
| JP | 64029097 | | 2/1989 |
| JP | 334391 | | 4/1991 |
| JP | 6217296 | | 8/1994 |
| JP | 8102988 | | 4/1996 |
| JP | 9298798 | | 11/1997 |
| JP | 10094093 | | 4/1998 |
| JP | 10327491 | | 12/1998 |
| JP | 11215578 | | 8/1999 |
| JP | 2000350285 | A | 12/2000 |
| JP | 2000356808 | A | 12/2000 |
| JP | 2001500258 | A | 1/2001 |
| JP | 2001503552 | A | 3/2001 |
| JP | 2001320798 | A | 11/2001 |
| JP | 2003529976 | A | 10/2003 |
| JP | 2004147286 | A | 5/2004 |
| JP | 2005105892 | A | 4/2005 |
| JP | 2008514867 | A | 5/2008 |
| JP | 4140999 | B2 | 8/2008 |
| JP | 2010283867 | A | 12/2010 |
| JP | 2012134998 | A | 7/2012 |
| JP | 5122793 | B2 | 1/2013 |
| KR | 2008-0080258 | A | 9/2008 |
| KR | 10-1260543 | | 5/2013 |
| WO | 96/35313 | A1 | 11/1996 |
| WO | 97/09844 | A1 | 3/1997 |
| WO | 97/09846 | A1 | 3/1997 |
| WO | 98/10252 | A2 | 3/1998 |
| WO | 98/28942 | A1 | 7/1998 |
| WO | 01/52400 | A1 | 7/2001 |
| WO | 2004/030406 | A1 | 4/2004 |
| WO | 2006/130731 | A2 | 12/2006 |
| WO | 2006/130782 | A2 | 12/2006 |
| WO | 2009/067669 | A1 | 5/2009 |
| WO | 2009/151892 | A1 | 12/2009 |

OTHER PUBLICATIONS

International Search Report and Written Opinion mailed on Jul. 18, 2014, for International Patent Application No. PCT/US14/28345, filed Mar. 14, 2014 (17 pages).

Backman, 1999, "Improving Piezoelectric Speakers with Feedback," Proc. AES Convention 106, 10 pages.

Beck, 2006, "Hysteresis Characterization Using Charge Feedback Control for a LIPCA Device," Proc. SPIE Int. Soc. for Opt. Eng. 6170, 10 pages.

Furutani, 1998, "Displacement control of piezoelectric element by feedback of induced charge," Nanotechnology 9:93-98.

Decision of Dismissal of Amendment in Japanese Patent Application No. 2007-066645, dated Sep. 27, 2011, 6 pages.

EPO Search Report for European App No. 01901776.3, dated Nov. 2, 2005, 5 pages.

EPO Supplementary Partial Search Report for European App No. 01901776.3, dated Apr. 26, 2005, 6 pages.

EPO Supplementary Search Report for European App No. 01901776.3, dated Aug. 3, 2005, 6 pages.

International Preliminary Examination Report for International Patent App PCT/US01/00349, dated Nov. 22, 2002, 4 pages.

International Preliminary Report on Patentability for International Patent App PCT/US06/21189, dated Dec. 6, 2007, 7 pages.

International Search Report and Written Opinion for International Patent App PCT/US01/00349, dated Apr. 30, 2001, 6 pages.

International Search Report and Written Opinion for International Patent App PCT/US06/21189, dated Nov. 21, 2006, 8 pages.

International Search Report and Written Opinion for International Patent App PCT/US06/21311, dated Sep. 5, 2007, 8 pages.

International Search Report and Written Opinion for International Patent App PCT/US08/84359, dated Jan. 27, 2009, 6 pages.

International Search Report and Written Opinion for International Patent App PCT/US09/44544, dated Nov. 13, 2009, 7 pages.

International Search Report and Written Opinion for International Patent App PCT/US10/45628, dated Oct. 6, 2010, 10 pages.

International Search Report and Written Opinion for International Patent App PCT/US11/44564, dated Oct. 31, 2011, 9 pages.

International Search Report for International Patent App PCT/GB97/03090, dated Jun. 9, 1998, 5 pages.

Azom.com, A to Z of Materials, Cellulose Acetate—CA, added May 7, 2001, available at http://azom.com/article.aspx?ArticleID=383, retrieved Mar. 16, 2012, 2 pages.

Edmund Optics Worldwide, "TECHSPEC Linear Polarizing Laminated Film," available at http://www.edmundoptics.com/onlinecatalog/displayproduct.cfm?productID-1912, retrieved Dec. 3, 2009, 2 pages.

(56) References Cited

OTHER PUBLICATIONS

Harris, 1997, "The distributed-mode loudspeaker (DML) as a broadband acoustic radiator," Audio Engineering Society Preprint 4526 (D-6); Presented at the 103rd Convention Sep. 26-29, 1997, New York, 5 pages.

International Standard, 2006, "Adhesives—Peel test for a flexible-bonded-to-rigid test specimen assembly—Part I: 90 degree peel" ISO Reference No. ISO/FDIS 8510-1:2006 (E), 14 pages.

Kugel, "Bimorph-based piezoelectric air acoustic transducer: model," Sensors and Actuators A: Physical 69(3): 234-42.

PolymerProcessing.com, Poly(ethylene terephthalate), copyrighted 2000, 2001, available at http://www.polymerprocessing.com/polymers/PET.html, retrieved Mar. 16, 2012, 2 pages.

The Engineering Toolbox, Elastic Properties and Young Modulus for some Materials, available at http://www.engineeringtoolbox.com/young-modulus-d_417.html, retrieved Mar. 16, 2012, 4 pages.

The Physics Classroom, "Light Waves and Color—Lesson 1, How do we know light behaves as a wave?" available at http://www.physicsclassroom.com/Class/light/U12L1a.cfm, retrieved Dec. 3, 2009, 2 pages.

* cited by examiner

ACOUSTIC TRANSDUCERS

RELATED APPLICATION

This application claims the benefit of and priority to Provisional U.S. Patent Application Ser. No. 61/791,355, filed Mar. 15, 2013, the entirety of which is incorporated by reference herein.

FIELD OF THE INVENTION

The invention generally relates to acoustic transducers having a member that limits bending of the diaphragm.

BACKGROUND

A loudspeaker is a transducer that produces sound in response to an electrical audio signal input. The vast majority of loudspeakers in use today are electromagnetic transducers. Referred to as dynamic loudspeakers, that class has essentially remained unchanged since the 1920's. Typically, a linear motor, such as an electromagnetic or electrostatic motor, actuates a diaphragm, which causes sound waves to be emitted by the speaker.

More recently, a new class of mechanical-to-acoustical transducers has been developed. Those transducers may have an actuator that may be coupled to an edge of a speaker diaphragm or diaphragm that may then be anchored and spaced from the actuator. In such transducers, the actuator is typically a piezoelectric actuator. Mechanical motion of the actuator is translated into movement of the diaphragm, generally in a direction that is transverse to the direction of motion of the actuator. The diaphragm radiates acoustic energy. Mechanical-to-acoustical transducers are exemplified in each of U.S. Pat. Nos. 6,720,708 and 7,038,356.

A problem with this new class of mechanical-to-acoustical transducers is durability. For example, unlike most dynamic loudspeakers, the diaphragm is not completely housed in an enclosure. Being exposed to the environment, means the diaphragm is vulnerable to normal wear and tear, such as bumping into and against other objects in a room. Collisions with the diaphragm may bend the diaphragm to the point of cracking or breaking.

SUMMARY

The invention provides more durable mechanical-to-acoustical transducers that are designed to better withstand the environment in which they will be used without breaking. Acoustic transducers of the invention include a diaphragm, a support, and an actuator coupled to the diaphragm to cause movement of the diaphragm. In particular, acoustic transducers of the invention include a member that limits bending of the diaphragm. The member limits the diaphragm from bending beyond a certain limit in a direction that is perpendicular to its plane at the point where it attaches to the actuator. In that manner, the diaphragm is protected from external forces, such as from dropping, normal contact or other events. Any configuration of a member that limits bending of the diaphragm is contemplated by this invention. In certain aspects, the member is a slot in a housing which forms a mechanical stop on one or more sides of the diaphragm. The member can also be positioned as a mechanical stop on only one side of the diaphragm. The member may be positioned at any type of orientation or distance relative to the diaphragm and may be configured to limit bending to any degree. In various configurations, the member may permit different degrees of diaphragm bending. In certain embodiments, the member surrounds the diaphragm. In other embodiments, the member is located behind the diaphragm.

In one configuration, the member includes two structures configured to wrap around left and right vertical edges of the diaphragm. The member may also consist of a number of posts located along one or both sides of the diaphragm. An exemplary configuration of the member is one that includes a housing having a slot. The housing is configured to fit over the diaphragm while the diaphragm extends through the slot. The slot limits movement of the diaphragm. The diaphragm can be straight or curved to various degrees. The slot and the slot may be shaped so that it corresponds to the shape of the diaphragm. In particular embodiments, the diaphragm is curved and the slot includes a curve that corresponds with the curve of the diaphragm.

The member may be coupled to the support in order to maintain a desired spatial relationship to the diaphragm during normal use and to provide support to the member when it is actively limiting bending of the diaphragm. In certain embodiments, the member is removably coupled to the support.

The member can be constructed of any suitable material. In various embodiments, suitable materials for the member include plastic, glass, metal, carbon-fiber composite, rubber, wood, or any combination thereof.

Transducers of the invention may use any type of diaphragm and actuator for moving the diaphragm. For example, the diaphragm can be prepared from any solid material, such as plastic, an optical-grade material, metal, carbon-fiber composite, fabric, foam, paper, or any combination of these. Actuators suitable for use with the invention include piezoelectric actuators and in certain embodiments, bending type piezoelectric actuators including unimorph, bimorph, trimorph, or other multimorph type benders.

DETAILED DESCRIPTION

The invention generally relates to acoustic transducers. In certain embodiments, the transducers of the invention have bending type piezoelectric actuators where the diaphragm is curved, the piezoelectric actuator is mechanically attached to the diaphragm and where the movement of the mid-point of the diaphragm between actuator and support or between two actuators moving against each other is mechanically amplified relative to the movement of the actuator by virtue of its mechanical construction. Such a transducer is subsequently called a mechanically amplified transducer. FIGS. 1-7 show an exemplary acoustic transducer of the invention. Transducers of the invention may include a support 100. The support may be a base as shown in FIGS. 1-7. Transducers of the invention may receive their audio signal or signals by wired or wireless connection to the signal source. Wireless transducers are described for example in Carlson (U.S. patent application number 2010/0322455), the content of which is incorporated by reference herein in its entirety.

Transducers of the invention may include a diaphragm 101. The diaphragm 101 may be a thin, flexible sheet. The diaphragm may be flat or formed with curvature, for example a parabolic section. In certain embodiments, the diaphragm includes several curvatures. In certain embodiments, when in its resting position the diaphragm is curved in the section between the piezo actuator attachment point and a support (or a second actuator). The diaphragm may be any solid material including such plastics as Kapton (poly amide-imide), polycarbonate, PMMA, PET, PVDF, polypropylene, or related polymer blends; or optical quality materials such as tri-acetates, and tempered glass; or aluminum, titanium or other metals; or carbon fiber composite; or paper; or resin doped fabrics; or foams; or other composites. The diaphragm in certain embodiments is made of a material with no or with only negligible piezoelectricity. The diaphragm may be made to be opaque or optically clear. The diaphragm may include a light polarizing layer or a damping layer, or both. Polarizing and damping layers are described for example in Booth (U.S. patent application number 2012/0186903), the content of which is incorporated by reference herein in its entirety. The diaphragm may also be coated with a light diffusion texture or coating to facilitate the projection of images or light. The diaphragm may be composed of a flexible display component.

Figure 1:
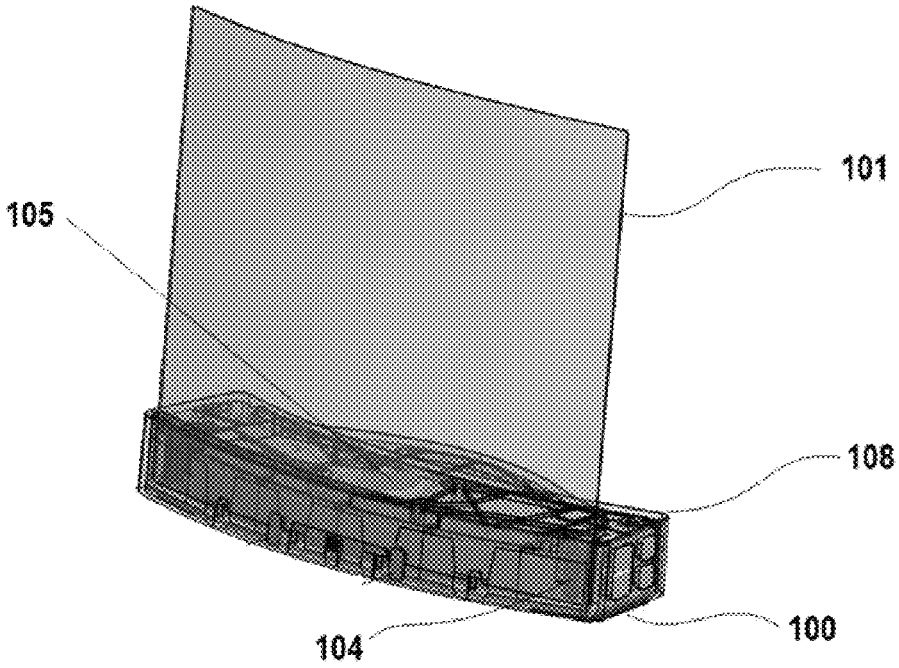
FIG. 1 is a schematic showing a front view of an acoustic transducer of the invention.
Figure 2:
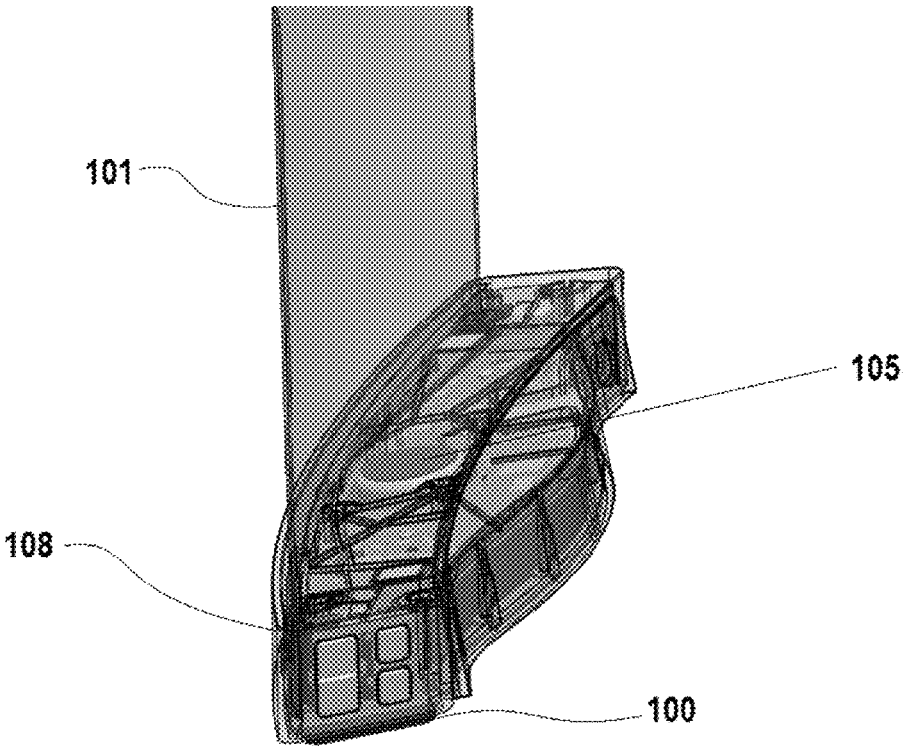
FIG. 2 is a schematic showing a side view of an acoustic transducer of the invention.
Figure 3:
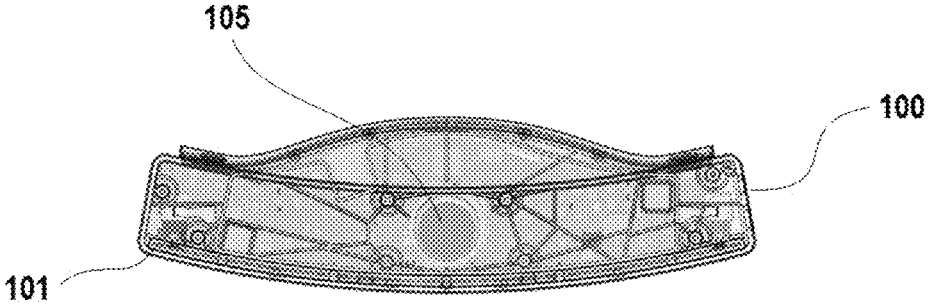
FIG. 3 is a schematic showing a top-down view of an acoustic transducer of the invention.
Figure 4:
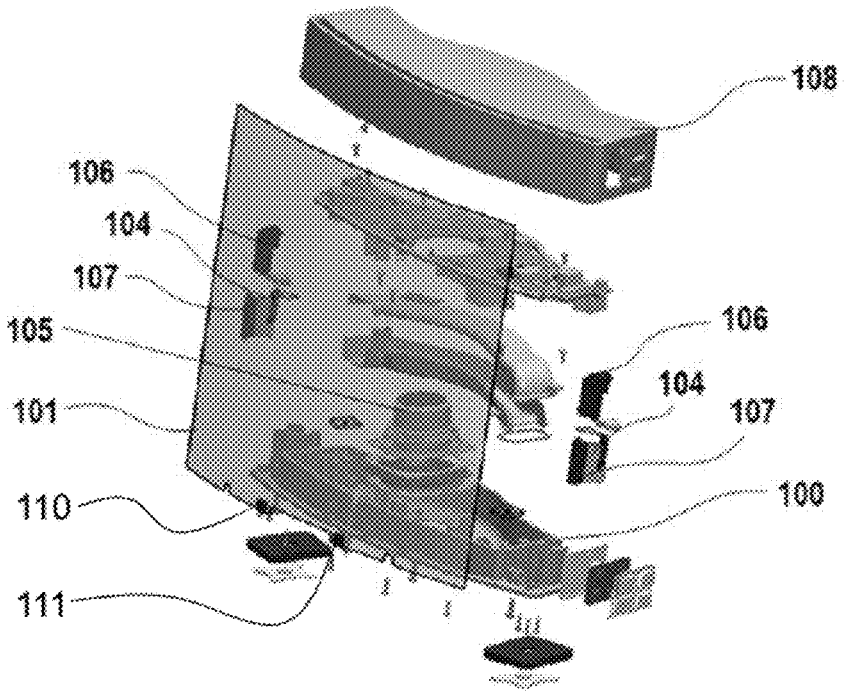
FIG. 4 is a schematic showing an exploded front perspective view of an acoustic transducer of the invention.
Figure 5:
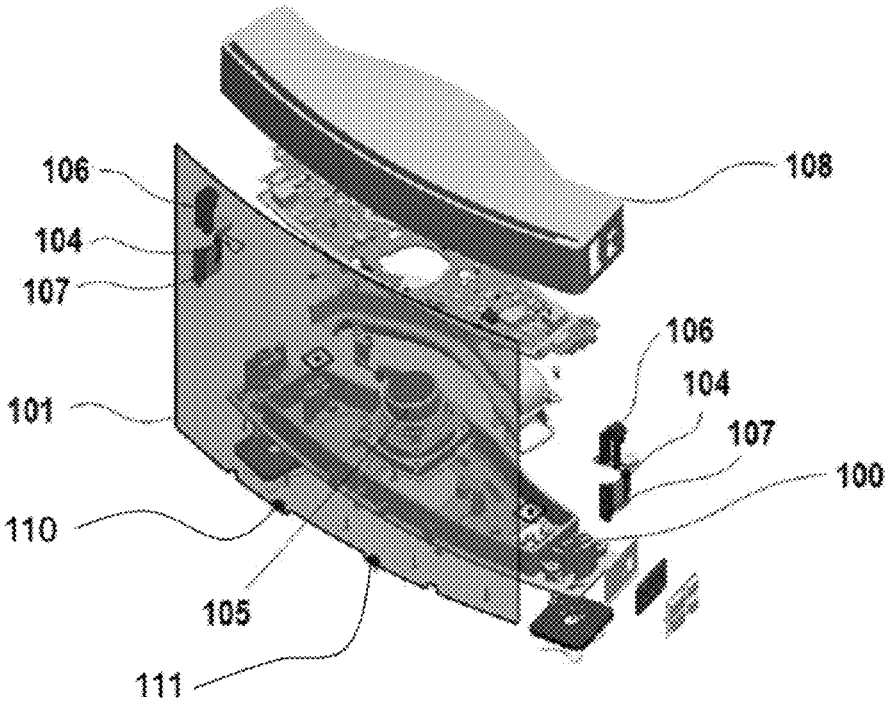
FIG. 5 is a schematic showing an exploded top-down/front perspective view of an acoustic transducer of the invention.
Figure 6:
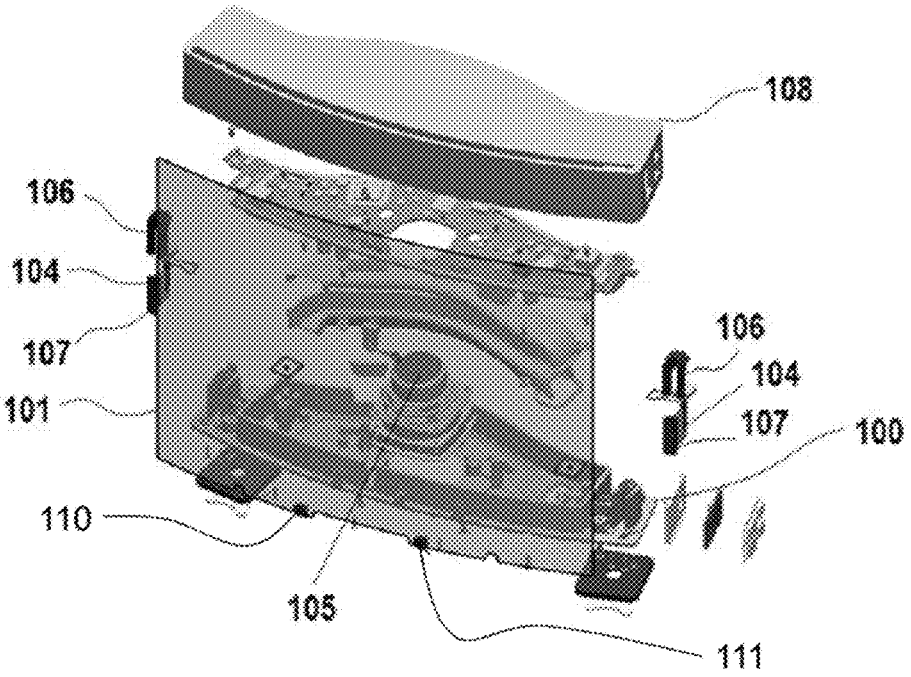
FIG. 6 is a schematic showing an exploded front view of an acoustic transducer of the invention.
Figure 7:
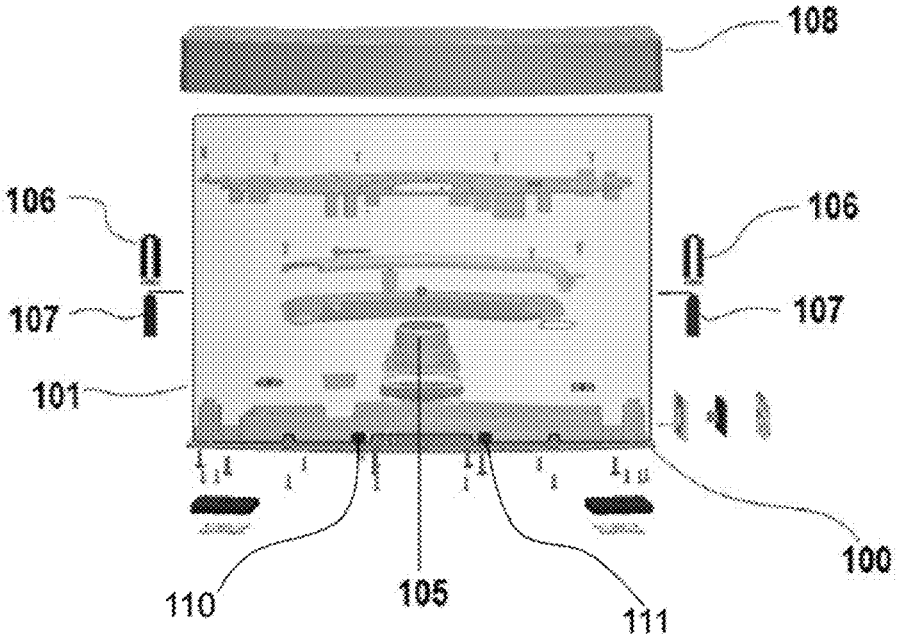
FIG. 7 is a schematic showing an exploded front perspective view of an acoustic transducer of the invention.

The diaphragm 101 couples to the support 100. When the diaphragm 101 is curved, the support 100 may include a curve that matches the curve of the diaphragm. The exemplary coupling in FIGS. 1-3 show a bottom portion of the diaphragm 101 coupling to the support 100. In a particular embodiment, the coupling is so that the diaphragm 101 is substantially perpendicular to the support 100. The coupling may be by any mechanism known in the art, e.g., adhesives, friction, clamp, fasteners, rivets, material connection such as those made by laser welding or ultrasonic welding, or magnetic connection. The diaphragm 101 is coupled to support 100 via at least one contact point. In some embodiments, more than one contact point will be used for the coupling, such as the actuator and a portion of a support. Those contact points are flanges on the front and back of the support 100. The diaphragm 101 fits between the flanges at the contact points and is coupled to the diaphragm. By using two contact points, the diaphragm is effectively split into two regions, thereby allowing the diaphragm to produce sound independently from a first portion of the diaphragm and a second portion of the diaphragm. That concept is further described in Athanas (U.S. Pat. No. 6,720,708), the content of which is incorporated by reference herein in its entirety.

It is important to note that the above description is exemplary and not limiting of the invention. Numerous other coupling configurations are possible and the invention is not limited to any specific coupling configuration. For example, transducers of the invention can be configured so that the coupling points are one actuator and one support, or one actuator and multiple supports, or two or more actuators (opposing each other) and no support at all, as well as two or more actuators and one or more supports.

Transducers of the invention include at least one actuator 104 that is coupled to the diaphragm. In certain embodiments, the actuator is a bending type piezoelectric actuators such as for example unimorph, bimorph, trimorph, or multimorph type benders. In certain embodiments, a single actuator designed transducer has the actuator coupled to a center line of the diaphragm. FIGS. 1-7 show an embodiment that uses two actuators 104. The actuators 104 are shown to be coupled along a bottom portion of the diaphragm on the lower left and lower right sides of the diaphragm 101. This location of the actuators is exemplary and other couplings are within the scope of the invention. In certain embodiments, the actuators 104 are also coupled to the support 100, although this is not required. The coupling is exemplified in FIGS. 8-11. Essentially, the actuator is seated in a hollowed-out section of the base and coupled to the base, by for example, thermal bonding, adhesive, or mechanical clamping. In certain embodiments, the actuator can also sit in a separate holder piece that in turn is attached to the base.

Any type of actuator known in the art may be used with methods of the invention, and an exemplary actuator is a piezoelectric actuator. A piezo bimorph is one type of suitable drive mechanism or actuator for this invention. An example of a Piezo Multimorph is a five layer device consisting of four plates of piezo material with a conductive coating on each side bonded to a central substrate. The substrate provides some spring force. It also can act as a dampener. The piezo plates are available for example from CTS Electronic Components, Inc. Piezoelectric Products 4800 Alameda Blvd NE Albuquerque, N. Mex. 87113. A type that may be used is 3195STD. The piezo plates expand or contract in the X- and Y-axis (a direction generally aligned with vertical axis and lying in the plate). In one configuration the plates are stacked up with alternating poling direction on each side and driven with a signal that is inverted relative from one side to the other. As a result, two plates expand, and the other two plates contract at the same times, which causes the actuator to bend in the z-direction. The final bending motion far exceeds the expansion of a single piezo wafer's movement.

The coupling of the actuators 104 to the diaphragm 101 is such that movement of the actuators causes the diaphragm to move in a direction transverse to the movement of the actuators. Further description of how the actuators cause movement of the diaphragm is described in Athanas (U.S. Pat. Nos. 6,720,708; 7,038,356), Johnson (U.S. Pat. No. 7,884,529), Carlson, et al. (U.S. Pat. No. 8,068,635), and Booth, et al. (U.S. Pat. No. 8,189,851), the content of each of which is incorporated by reference herein in its entirety.

The base 100 may hold the electronics of the acoustic transducer. Electronics for loudspeakers are described for example in Burlingame (U.S. patent application number 2011/0044476), the content of which is incorporated by reference herein in its entirety. The base may also optionally hold a speaker. FIGS. 1-7 show an exemplary base 100 holding a speaker 105. In such an embodiment, the speaker 105 emits acoustic energy at a first range of frequencies. In such an embodiment, the diaphragm 101 emits acoustic energy at a second range of frequencies. The first and second ranges may overlap or even be identical. However, in a preferred embodiment, the first and second ranges have little to no overlap once an electronics crossover is applied to the audio signal. In an exemplary embodiment, the speaker in the base is the primary emitter of acoustic energy at a frequency range of 250 Hz and below, while the diaphragm is the primary emitter of acoustic energy at a frequency range from 250 Hz to 20 kHz.

FIGS. 1-7 exemplify transducers in which the diaphragm 101 has at least one free edge. In FIGS. 1-3, the diaphragm 101 has more than one free edge, i.e., the left and right edges and the top edge are free in space. Only the bottom edge of the diaphragm 101 is restrained in that is coupled to the support 100. In another embodiment the diaphragm is connected to actuators at the bottom edge, to the support at the top edge leaving a free edge at the left and right edge. FIG. 17-21 show several examples of this embodiment. In other embodiments, the bottom edge of the diaphragm 101 is restrained in that is coupled to the support 100, auxiliary vertical supports are used on parts of the left and right edges, leaving only the top edge of the diaphragm free in space.

Furthermore, in FIG. 29-32 there is an attachment point between actuator and diaphragm D and between diaphragm and support S as well as a plane P between the points D and S. The piezoelectric bender moves towards points a or b depending if a positive or negative voltage is applied to the bender. There is a corresponding audio signal amplifier that has a maximum and minimum voltage output. If maximum or minimum voltage is applied at the piezo bender the bender has maximum positive or negative excursion indicated by points a and b. There is also a resting state O. The movement of the attachment point D as voltage is applied follows a curved route. The movement between resting point O and end point A or B can be described by two vectors X and Y with X being parallel to plane P and Y being perpendicular to plane P.

As the diaphragm is mechanically attached to the bender the diaphragm will see a component of its excursion F and G that are perpendicular to plane P. F and G are observed half way along the curvature of the diaphragm between the attachment point of the actuator D and the support S. Typically, the displacement of the diaphragm F is larger than the sum of displacements X and Y. If the piezo bender moves in the opposite direction correspondingly displacement G is larger than the sum of displacements X' and Y'. This type of transducer is mechanically amplified.

By coupling the distal end of a piezo actuator to a curved diaphragm the lateral component of the motion of the distal end of the actuator is converted to a larger perpendicular motion of the diaphragm surface.

Figure 29:
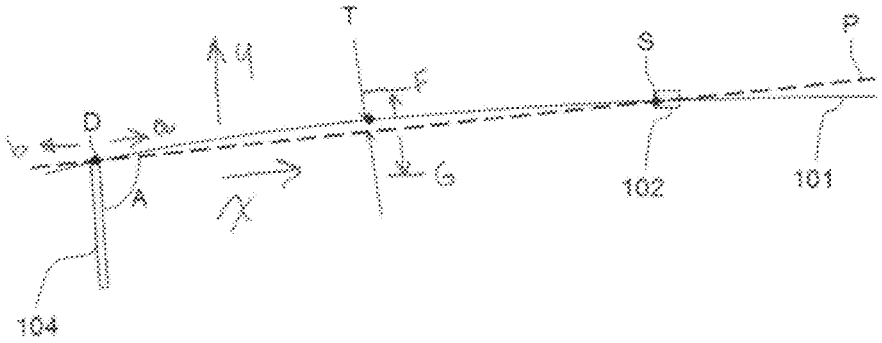
FIG. 29 is a schematic showing an actuator and curved diaphragm with actuator perpendicular to Plane P.

FIG. 29 shows attachment points between the actuator and diaphragm at point D and between the diaphragm and a fixed support at point S. It is noted that the support can be replaced by another actuator that is driven with a signal that makes it move opposite to the movement of actuator 104. Using a reference plane P between the points D and S the tip of the actuator moves point D towards or away from point S depending on whether a positive or negative voltage is applied to the actuator.

Figure 39:
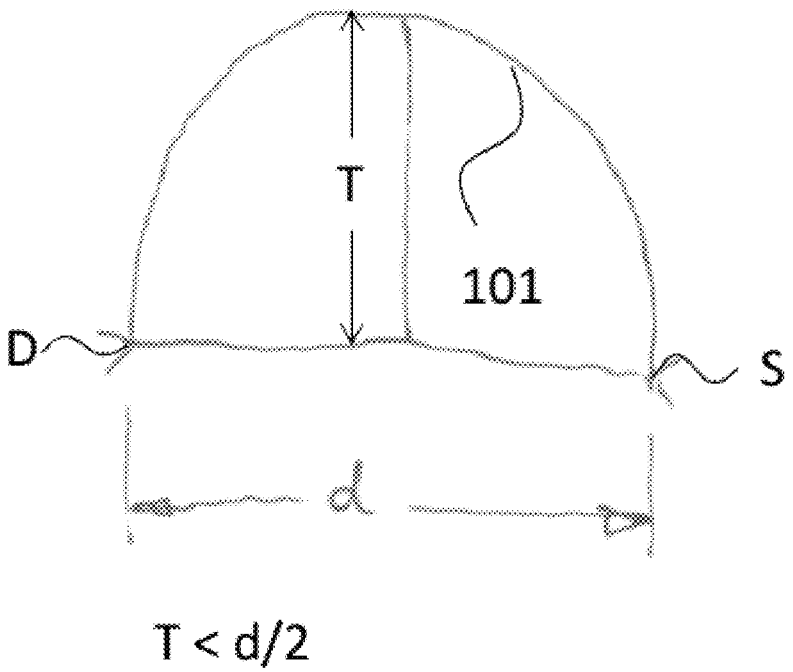
FIG. 39 is a schematic showing chord-length and chord-depth of a curved diaphragm.

The arc-length is the length of the diaphragm segment between points D and S. The chord-length d is the straight line distance between points D and S. The chord-depth T is the maximum perpendicular distance between the diaphragm segment and plane P. This is illustrated in FIG. 39.

The geometry and material properties of the curved diaphragm are chosen such that when the actuator or actuators exert a lateral force on the segment of the diaphragm between D and S the diaphragm will react by flexing and increasing or decreasing its curvature. This can be seen in FIG. 31-32. A change of curvature while maintaining a fixed arc-length results in a changing chord-depth T.

The geometry of the diaphragm is relatively thin and relatively long and its modulus is selected from a group of materials such as plastics, metals, paper, carbon fiber, foam, composites of the before and similar materials.

If such a diaphragm is curved between the attachment point D of the actuator and the support S, it has a substantially fixed arc-length. The lateral motion of the distal end of the actuator results in a change of the chord-length d of the arc. Due to geometric principles when the chord-length d changes and arc-length remains fixed the corresponding chord-depth T will change. In the case that the chord-depth T is less than half of the chord-length d, any incremental changes in the chord-length d will result into a larger incremental change in the chord depth T as long as the diaphragm does not take up a flat shape. We call this effect mechanical amplification. We call the ratio of the incremental change of chord depth T to chord-length d the amplification ratio. As the ratio of chord-length d to chord depth T increases so does the amplification ratio.

The amplification ratio is observed at a frequency significantly below the first mechanical resonance of the transducer and within a range of frequencies between 20 hertz and 20 kilohertz. In a preferred embodiment, the amplification ratio is, for example, at least 1.2, at least 1.5, at least 1.7, at least 2, at least 2.5, at least 3, at least 3.5, at least 4, at least 4.5, at least 5, at least 5.5, at least 6, at least 6.5, at least 7, at least 7.5, at least 8, at least 8.5, at least 9, at least 9.5, at least 10, at least 10.5, at least 11, at least 11.5, at least 12, at least 12.5, at least 13, at least 13.5, at least 14, at least 14.5, at least 15, at least 15.5, at least 16, at least 16.5, at least 17, at least 17.5, at least 18, at least 18.5, at least 19, at least 19.5, or at least 20. In other embodiments, the amplification ratio is any ratio between those recited above.

Figure 30:
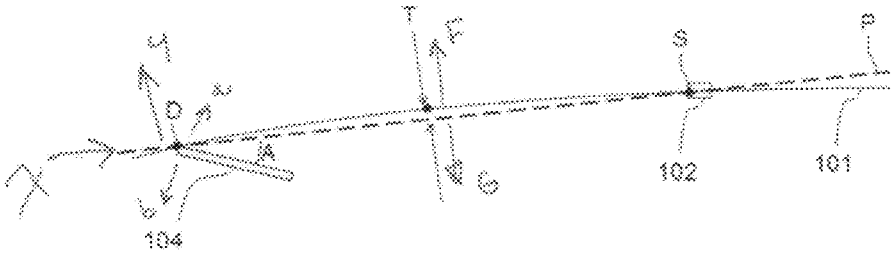
FIG. 30 is a schematic showing actuator and diaphragm with actuator at shallow angle A to Plane P.

In the construction of a speaker transducer the angle A formed between the distal end of the actuator and the plane P can be varied from perpendicular to very shallow angles which result in different proportions of mechanical amplification and motion in different regions of the diaphragm. FIG. 29 shows an example of a transducer with angle A at 90 degrees. FIG. 30 shows an example of a transducer with A close to 0 degrees.

Mechanical amplification occurs for angles A larger than zero degrees and less than 180 degrees. It is noted that actuators can also be attached at the opposite side of the diaphragm at the same point D. Furthermore, mechanical amplification only occurs when the cord-depth T is less than two times the cord-length d.

It is noted that in addition to diaphragm motion due to mechanical amplification the diaphragm will also move with a superimposed displacement equal to the vertical component of the motion of the distal end of the actuator. There is no such superimposed displacement if the angle A is 90 degrees.

At rest position the diaphragm has a neutral shape determined by the relaxed shape of the diaphragm as well as the constraints imposed by the actuator attachment and support. The positive to negative oscillation of the signal voltage to the actuators results in a corresponding positive and negative displacement of the diaphragm relative to the neutral position. This displacement of the diaphragm creates an acoustic air pressure change and allows this design to act as an audio transducer.

Figure 31:
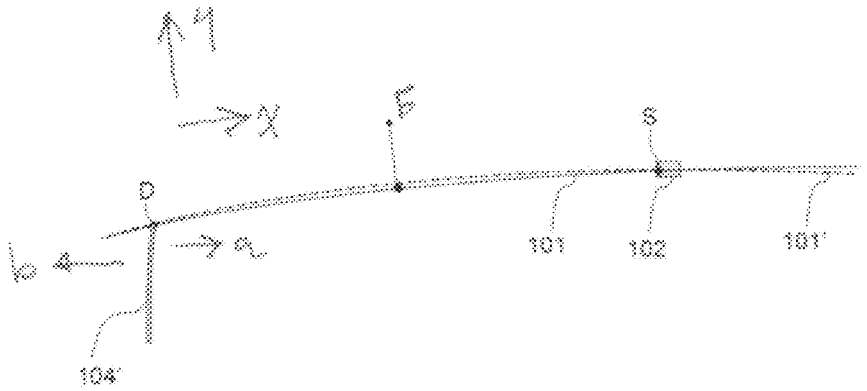
FIG. 31 is a schematic showing a diaphragm in rest position and an actuator and diaphragm in positive shape.

FIG. 31 shows the diaphragm 101 in its rest position as well as the piezo actuator 104' and the diaphragm 101' in its positive shape.

Figure 32:
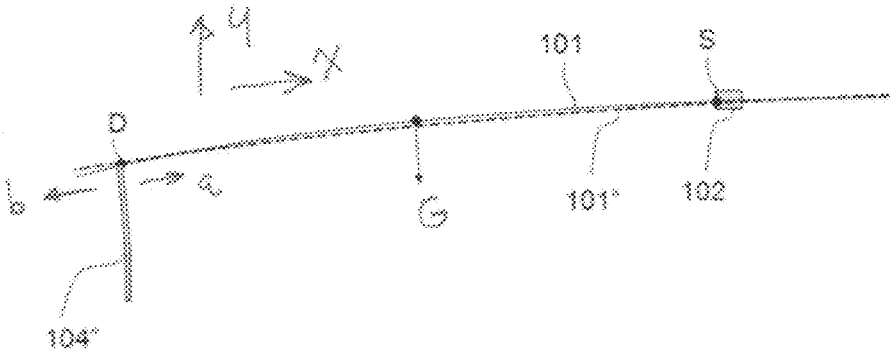
FIG. 32 is a schematic showing a diaphragm in rest position and an actuator and diaphragm in negative shape.

FIG. 32 shows the diaphragm 101 in its rest position as well as the piezo actuator 104" and the diaphragm 101" in its negative shape.

Various combinations of the length of the actuator, baseline chord depth T and chord length d result in different speaker transducer performance in terms of maximum sound pressure level and frequency response.

It is noted that the piezoelectric bender can attach at a wide range of angles relative to the diaphragm. In certain embodiments, transducers of the invention are configured such that movement of the actuator has a component x that is larger than 0 and where the displacement of the diaphragm F is larger than the sum of displacements X and Y. If x were zero then there would be no mechanical amplification of the diaphragm displacement relative to the bender displacement. It is further noted, that the diaphragm can overhang the actuator by any amount. Other variants of the amplified transducer include: actuator or actuators on two opposing sides, no support S; and actuator on two opposing sides, with support S in-between.

In certain embodiments, the transducer is configured such that the piezoelectric effect is limited to the actuator. This means that a piezoelectric actuator, that is separate and distinct from a diaphragm composed of non-piezoelectric material, is used to excite the diaphragm. In case there is any piezoelectric effect in the diaphragm, this is not utilized to actuate the diaphragm. There is no electrical connection between the diaphragm and the audio amplifier.

Acoustic transducers of the invention may optionally include additional features so that the transducer of the invention can better withstand the environment in which they will be used without breaking. For example, piezo actuators are relatively brittle and will get damaged under high dynamic loads and sudden impacts. Additionally, thin diaphragms, as may be used with transducers of the invention, may be fragile due to their relative thinness. If a user drops a transducer onto a floor, (for example from 120 cm height) several reliability problems can occur. For example, the piezo actuator may be damaged or the diaphragm may be damaged.

Reliability problems of this type can often be so severe that the intended use of the transducer is no longer possible. The damage to the piezo actuator typically occurs due to an impact on the transducer in the direction of plane P for example dropping of the product on the floor. The weight of the diaphragm will force the piezo actuator to bend beyond its mechanical breaking limit. A typical example of damage is cracks being created inside the piezoelectric material that cause a dielectric breakdown when voltage is applied and thus preventing the actuator from moving as designed.

A typical damage to the diaphragm is a crack, a hole or a discoloration that typically occur in close proximity to the attachment points between the diaphragm and the actuator or the diaphragm and support. The extent of the damage to the actuator or diaphragm depends on the specific material and design chosen for both. In general the damage will be more severe or will occur more easily the heavier and larger the diaphragm is for a given design. The damage will also be more severe or will occur more easily if the transducer design is of a frameless type. It will also be more severe if the impact is increased for example by increasing the drop height, the weight of the product or the stiffness of the surface the transducer is dropped on.

Particularly for frameless transducers, there is an additional reliability problem as the diaphragm can be bent or torn due to the lack of a frame or speaker grille. As an example, if such a frameless transducer is dropped from 120 cm height onto a hard surface, such as concrete or wood, damage to the piezo actuator or the diaphragm or to both is observed. Moreover, if the transducer is dropped in a plane of the diaphragm on the top side of the diaphragm the diaphragm will bend and create a high stress at the attachment points that leads to cracking of the diaphragm near the attachment point.

Exemplary features that can protect transducers of the invention include: (a) mechanical stop or stops to limit the maximum bending of the actuator; (b) connector piece or pieces with tapered edges; (c) actuator substrate with tapered edges; (d) diaphragm with integrated connector piece with tapered edges; (e) removable and re-attachable diaphragm; (f) mechanical stop to limit bending of diaphragm; (g) member to prevent edge impact onto diaphragm, (h) a relatively soft connector piece between support and diaphragm; and (i) auxiliary supports on the left and right sides, coupled at the top left and right corner. The preferred implementation for each of these measures is described below. The measures can be used individually or in conjunction to improve the reliability of mechanically amplified acoustic transducers with piezoelectric actuators.

The figures show a transducer that includes the additional features a), b), f), g) and h), although transducers of the invention do not need to include all of the features or can include more features at the same time. For example, transducers of the invention can be provided with none of the additional features, with one of the additional features, or with all of the additional features. Stated another way, the additional features described herein are optional, and no embodiment of the invention should be interpreted to require any of the additional features. Also, any combination of the features may be used with transducers of the invention.

(a) Mechanical Stop or Stops

Figure 8:
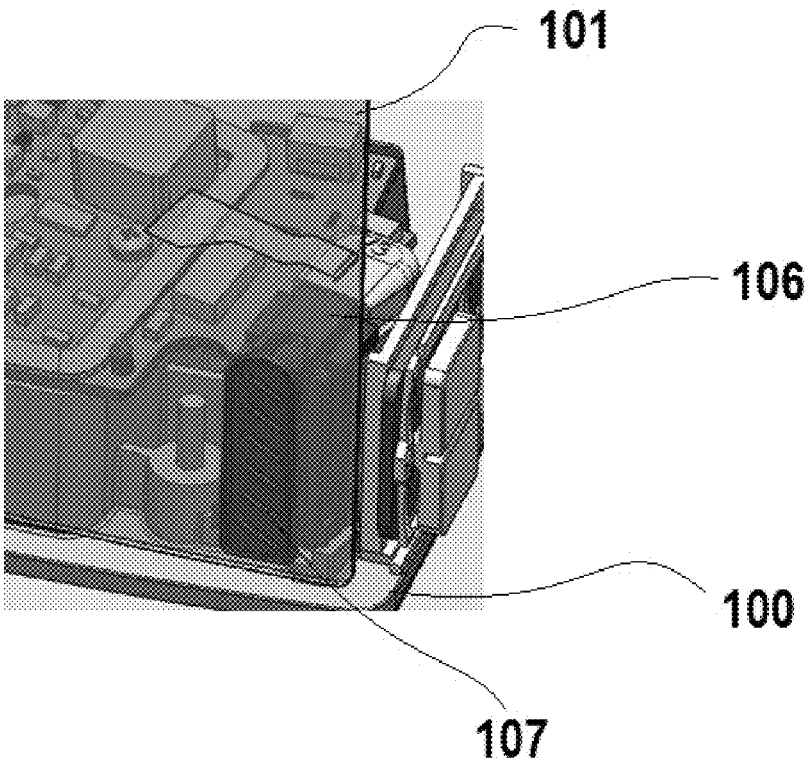
FIG. 8 is a schematic showing front perspective view of a member that limits movement of an actuator.
Figure 9:
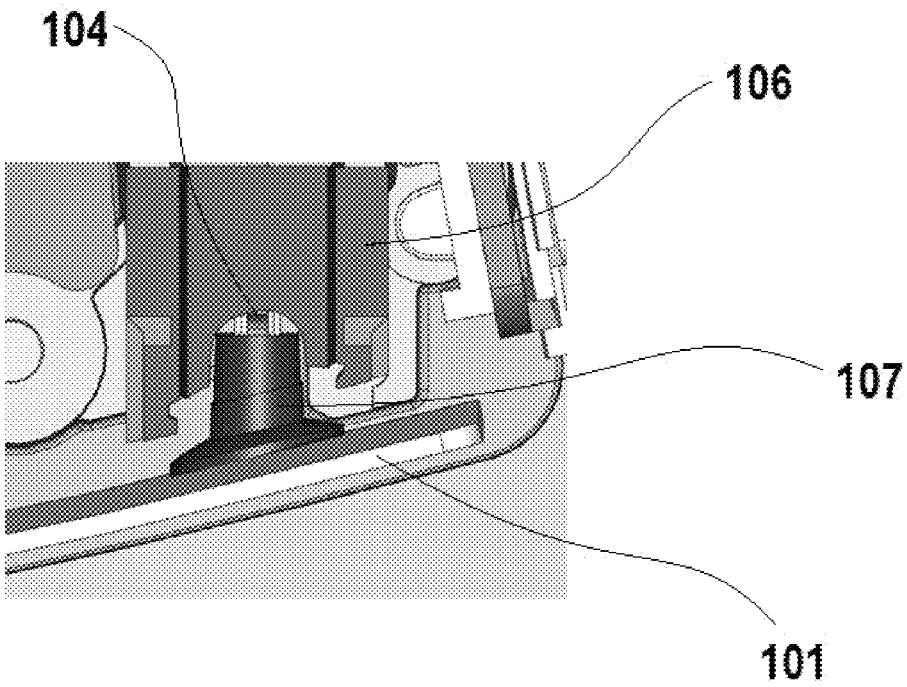
FIG. 9 is a schematic showing top-down view of a member that limits movement of an actuator.
Figure 10:
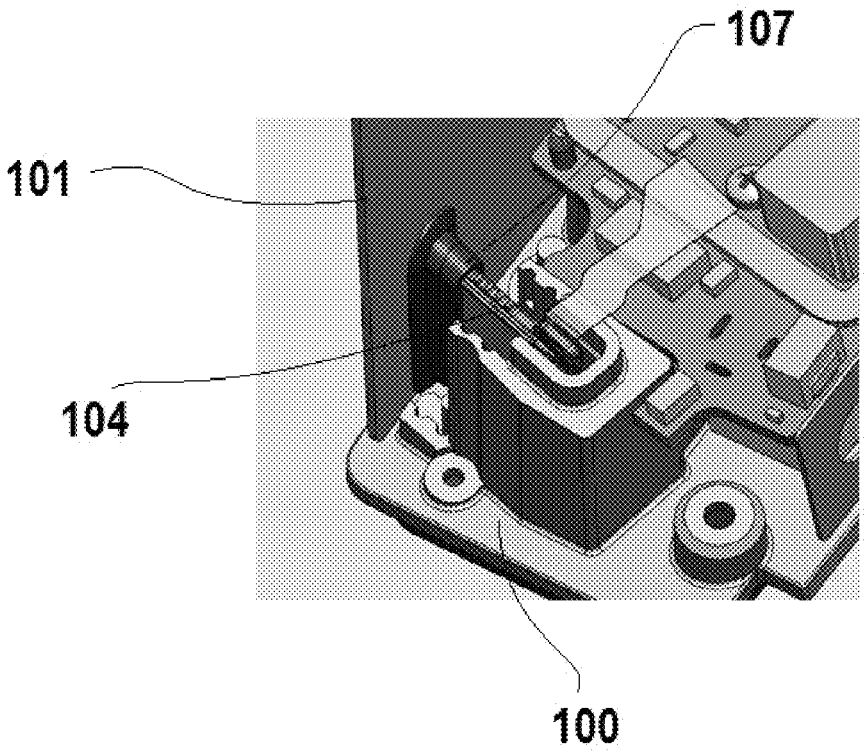
FIG. 10 is a schematic showing a side perspective view of a connector that couples an actuator to a diaphragm.
Figure 11:
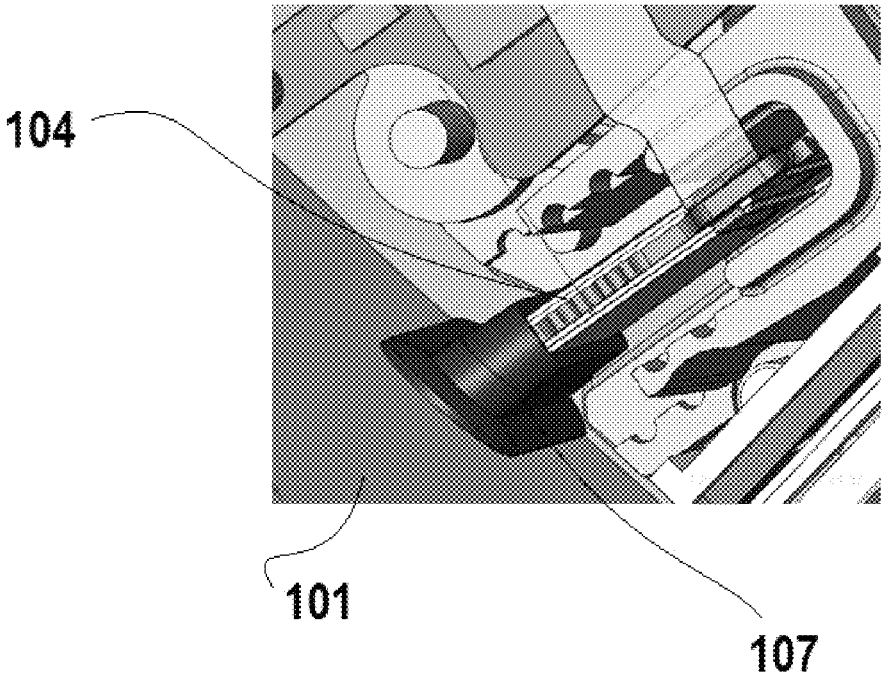
FIG. 11 is a schematic showing a top-down perspective view of a connector that couples an actuator to a diaphragm.

A first feature may be a member that limits bending of the actuator. That member can be seen as 106 in FIGS. 4-7. FIGS. 8-9 show a view of the member 106 fitted over the actuator 104. By limiting bending of the actuator, the ceramic within the actuator is protected from cracking or breaking. This is particularly useful in cases were the speaker is jostled or dropped. Typically, the member is configured so that it does not limit movement of the diaphragm coupled to the actuator when they are within the operating range as an acoustic transducer, as shown in FIGS. 8-9. In certain configures, a distal end of the actuator is coupled to the diaphragm and the member is positioned to interact with a distal portion of the actuator. In other embodiments, the member acts on a coupling piece that connects actuator and diaphragm. In other embodiments, the diaphragm is curved and the member is configured to limit bending of the actuator without interfering with the curved diaphragm when the actuator is used within the standard operating range as an acoustic transducer. The member may be integrally formed with the transducer or may be removably coupled to the transducer. The member exemplified in FIGS. 4-9 is removable from the actuator. In certain embodiments, the actuator includes first and second sides, and the member is configured to interact with only the first or second side. In other embodiments, the actuator includes first and second sides, and the member is configured to interact with both the first and second sides. The safe range depends on the specific construction of the actuator and the transducer and can range from a few hundreths of a mm to several mm on each side of the actuator. An example for a safe range that actuator bending is limited to by the member is 0.15 mm on each side of the actuator for the case of a multimorph constructed out of 4 piezo plates with 0.3 mm thickness each and one FR4 substrate with 1 mm thickness and with the actuator having a free height of 20 mm. Free height is the distance from the bending tip of the actuator to the point where the actuator is starting to be anchored in the support. The safe range is usually determined experimentally in repeated drop tests as well as bending tests of actuators. The safe range is usually larger than the maximum excursion of the actuator under intended use as a transducer. For the above actuator the internally driven operating deflection of the actuator is a small fraction of the breaking limit (approximately 0.05 mm in each direction).

Figure 14:
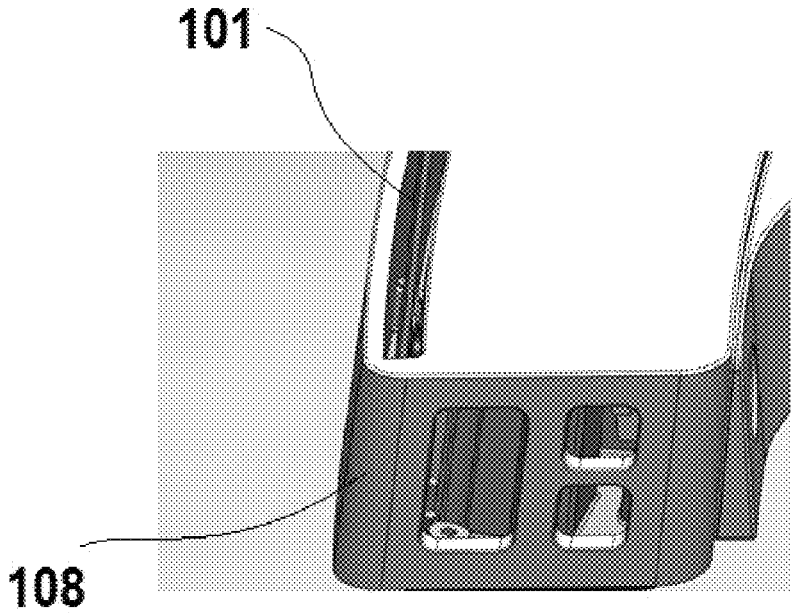
FIG. 14 is a schematic showing a side view of a member that limits movement of a diaphragm.
Figure 15:
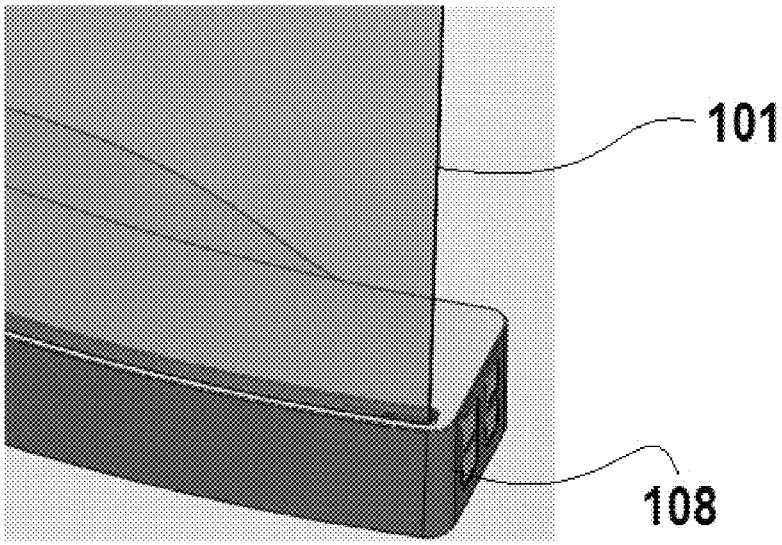
FIG. 15 is a schematic showing a front view of a member that limits movement of a diaphragm.

The member that limits bending of the diaphragm 101 is shown as 108 in FIGS. 1-7 and also in FIGS. 14-15. In certain embodiments, the member 108 is configured so that it limits the diaphragm 101 from bending beyond a certain limit in a direction that is perpendicular to its plane at the point where it attaches to the actuator 103. In this manner, the diaphragm 101 is protected from external forces, such as from dropping, normal contact or other events.

The member may be any component that limits bending of the actuator. The member may be composed of any material, and exemplary materials include plastics, metals and rubbers. A specific exemplary configuration for the member is shown in FIGS. 4-9. That embodiment shows a member that has first and second vertical sides and a top portion that connects the first and second sides. The member may be sized to fit over the actuator. In certain embodiments, the transducer additionally includes a connector 107 that couples the actuator 104 to the diaphragm 101. In those embodiments, the member 106 may limit bending of the actuator through interaction with the connector 107, as shown in FIGS. 8-9.

Figure 12:
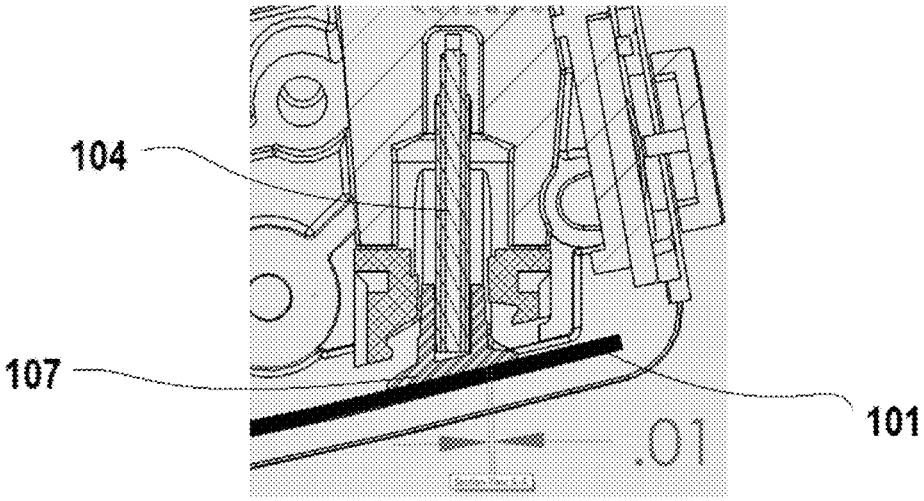
FIG. 12 is a schematic showing a top-down, cutaway view of a connector that couples an actuator to a diaphragm.
Figure 13:
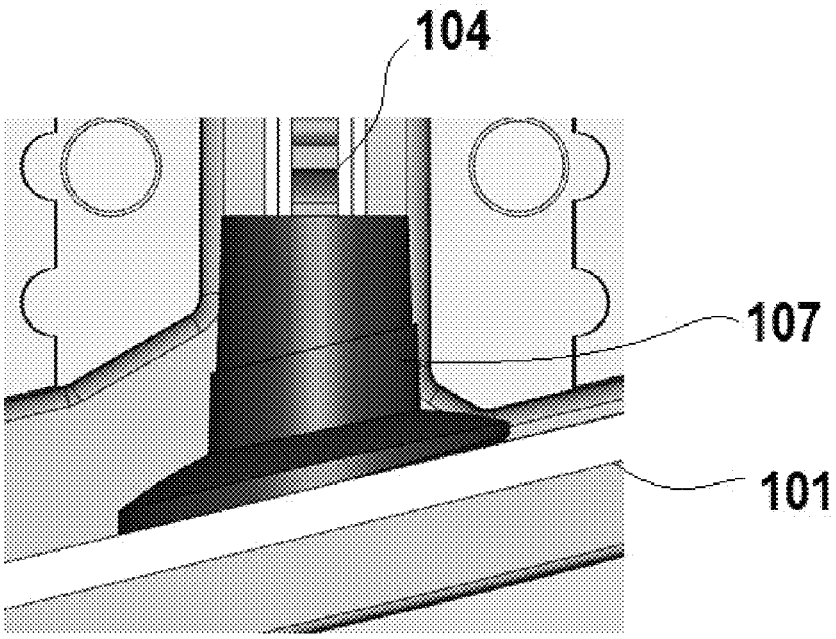
FIG. 13 is a schematic showing a top-down view of a connector that couples an actuator to a diaphragm.

The member may also be an integral feature of the "base/support" instead of a separate part. FIG. 12 shows an exemplary spacing between the connector 107 and an internal part of the base 100, showing that even with the connector 107, the actuator 103 is able to sufficiently move to cause movement of the diaphragm 101. FIG. 13 shows an exemplary embodiment in which the diaphragm 101 is curved. In such an embodiment, the proximal end of the connector 107 is angled to accommodate the curve of the diaphragm 101 while still being able to couple the actuator 104 to the diaphragm 101.

(b) Tapered Connector

Prior art teaches the use of a substrate with a bent over top section against which the diaphragm is attached. The disadvantage of this construction is that a sharp transition corner all around the attachment point or attachment area is formed. This stiffness of the diaphragm changes dramatically at this corner and the corner acts as a stress concentrator. Any sudden impact on the transducer will create a localized very high force at the corner where the diaphragm attaches to the substrate. This high force then causes cracks or holes in the diaphragm or separation of the diaphragm from the substrate or damage to the substrate or a combination of these when dropped for example from a height of 120 cm onto a concrete or wood floor.

In order to overcome this problem a connector with tapered edges is introduced. The connector is shown as 107 in FIGS. 4-7. The connector is also shown in FIGS. 10-13. The connector has a planar proximal end that tapers to a distal end. The proximal end is coupled to the diaphragm 101 and the distal end is coupled to the actuator 104 such that the actuator 104 causes movement of the diaphragm 101. Due to the tapered design of the connector the stiffness of the diaphragm changes gradually when observing it from the unconstrained diaphragm towards the center of the attachment area. This causes the stress loads to be distributed over a larger area and the localized maximum force to be reduced significantly.

Connectors of the invention may have any type of taper. For example, in certain embodiments, the left and right sides of the connector taper from the planar proximal end to the distal end. In other embodiments, the top and bottom sides of the connector taper from the planar proximal end to the distal end. In particular embodiments, all sides of the connector taper from the planar proximal end to the distal end, as is shown in FIGS. 10-13.

Any connecting mechanism may be used to couple the connector to the diaphragm. For example, the connector may be coupled to the diaphragm by adhesives, friction, clamp, fasteners, rivets, material connection such as those made by laser welding or ultrasonic welding, or magnetic connection. The connector also needs to couple to the actuator. An exemplary way to make this connection it to configure the connector such that a portion of the actuator 104 fits within the distal end of the connector 107, as shown in FIGS. 10-13. The connection between connector and actuator can be made for example with an adhesive.

(c) Actuator Substrate with Integrated Connector Piece with Tapered Edges

In some embodiments, the tapered edge or edges as described in (b) above that connect the diaphragm to the actuator are not a separate connector piece but are integrally formed with the substrate element of the actuator. A preferred implementation is a substrate of the actuator that is produced as an injection molded or cast part out of plastic or metallic material and that combines the tapered feature of the connection area with the desired geometry of the actuator substrate.

(d) Diaphragm with Integrated Connector Piece with Tapered Edges

In some embodiments, the connector as described in (b) above is integrally formed with the diaphragm. A distal end of the actuator attaches to the connector as described above, for example by a portion of the actuator fitting within the distal end of the connector. A preferred implementation is a diaphragm made by injection molding, casting or thermoforming that combines the general shape of the connector described above with the desired geometry of the diaphragm into one part.

(e) Removable and Re-Attachable Diaphragm

In certain embodiments, transducer of the invention are designed such that the diaphragm is removable coupled to the actuator. The strength of the connection is designed such that the diaphragm will release from the actuators at a force that is less than an impact force that would damage the diaphragm. In that manner, the diaphragm releases from the actuator prior to a force being applied to the diaphragm that would damage either the diaphragm or the actuators. Any type of releasable connection may be used. In exemplary embodiments, the releasable connection is accomplished using magnets or friction based claims. The strength of the magnets are tuned such that the magnets come loose before a force impact would damage either the diaphragm or the actuator. Other connections may be formed using tapered wedges that create very stiff connections laterally but may be separated easily in a direction parallel to the plane of the actuator.

(f) Mechanical Stop to Limit Bending of Diaphragm

One of the potential ways the diaphragm can get damaged during a drop, from for example 120 cm, onto a floor is by the transducer dropping onto the diaphragm itself and causing it to bend. This is a particular problem for a transducer with a frameless diaphragm as shown in FIGS. 1-7. If the transducer with a frameless diaphragm is dropped such that the first impact to the floor is made by the diaphragm the diaphragm can be made to bend. In some cases the diaphragm might be bent as much as 180 degrees forcing it momentarily into a U-shape. This bending will cause an extreme stress concentration at the edge of the attachment area between diaphragm and actuator or diaphragm and connector piece. The diaphragm can be constructed to be rugged enough to survive bending of 180 degrees and to spring back into its original shape, however in many implementations the stress concentrator at the attachment area will cause the diaphragm to discolor or to crack. Discoloration is often a precursor of cracking so after application of multiple stresses cracking can be observed. Depending on the design this can even be the case if a design with a tapered edge as described in b), c) and d) above is utilized.

To overcome this problem a member is introduced to limit bending of the diaphragm. Any configuration of a member that limits bending of the diaphragm is contemplated by this invention. This member may act as a mechanical stop designed such that the diaphragm will contact the stop before the critical bending radius that causes damage at the attachment point to the actuator or connector is reached. In certain configurations, the mechanical stop may be a slot surrounding the diaphragm; vertical posts at the front, back, or both sides of the diaphragm; or a U or C-shaped member that surrounds each edge of the diaphragm. The effect of the mechanical stop is that bending and impact forces on the diaphragm are now distributed over two areas: the attachment point of the diaphragm to the actuator or connector and the contact area of the diaphragm and the mechanical stop.

Figure 33:
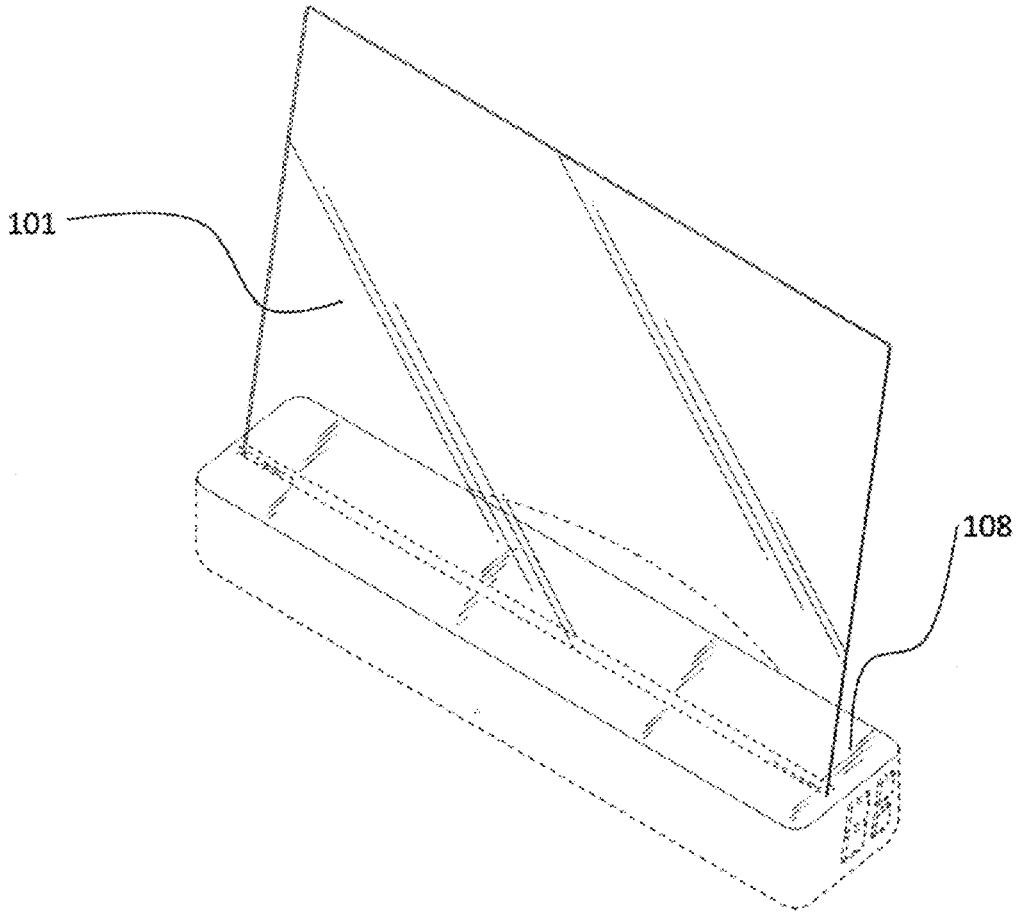
FIG. 33 is a schematic showing a side view of another embodiment of a member that limits the movement of the diaphragm.

The mechanical stop or member of the invention may have any type of orientation or distance relative to the diaphragm. For example, in certain embodiments, the mechanical stop has the form of a slot and limits bending from both planar sides of the diaphragm. The position of the diaphragm within the slot may be symmetric or asymmetric relative to the interior edges of the slot. FIGS. 1-7 and FIGS. 14-15 show an exemplary configuration of the member 108 as a housing having a slot. FIGS. 4-7 show various exploded views of an acoustic transducer which highlight the individual structure of the member 108 as a housing with a slot. FIG. 14 shows a side view of the member 108 and the diaphragm 101 illustrating the spacing between the diaphragm and the member during normal operation. The housing is configured to fit over the diaphragm 101 while the diaphragm extends through the slot. The slot then limits movement of the diaphragm. In certain embodiments, the diaphragm is curved and the slot includes a curve that corresponds to the curve of the diaphragm. In other embodiments, the diaphragm 101 is straight and the member 108 comprises a slot that is shaped to correspond to the diaphragm as shown in FIG. 33.

In exemplary embodiments, the mechanical stop does not contact the diaphragm during normal operation of the transducer and only interacts with the front or the back side diaphragm in case of a diaphragm bending event outside of allowable tolerances, such as 180 degrees. The safe range of diaphragm bending depends on the size, material, and shape of the diaphragm in addition to other factors including the diaphragm's attachment to the support, actuator, or connectors and may be anywhere between 1 degree and 360 degrees in either direction. The safe range is usually determined experimentally through stress testing for specific diaphragm materials and configurations. Exemplary acceptable degrees of diaphragm bending in either direction include: 10, 15, 45, 90, of 180.

Diaphragm bending can also be limited by a mechanical stop on only one side of the diaphragm. In particular embodiments, the member forms a slot and protects the diaphragm from bending on both sides at an equal distance as is shown in FIG. 15. In certain embodiments, the member surrounds the diaphragm. In other embodiments, the member is located behind the diaphragm as shown in FIG. 36.

Figure 34:
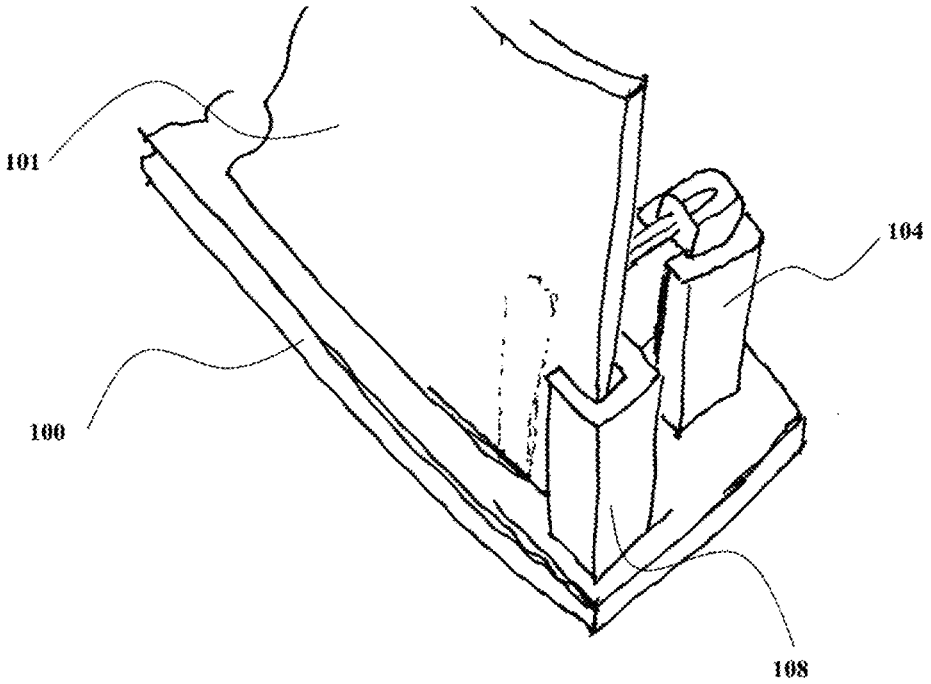
FIG. 34 is a schematic showing a perspective view of a transducer featuring a member that limits the movement of the diaphragm.
Figure 35:
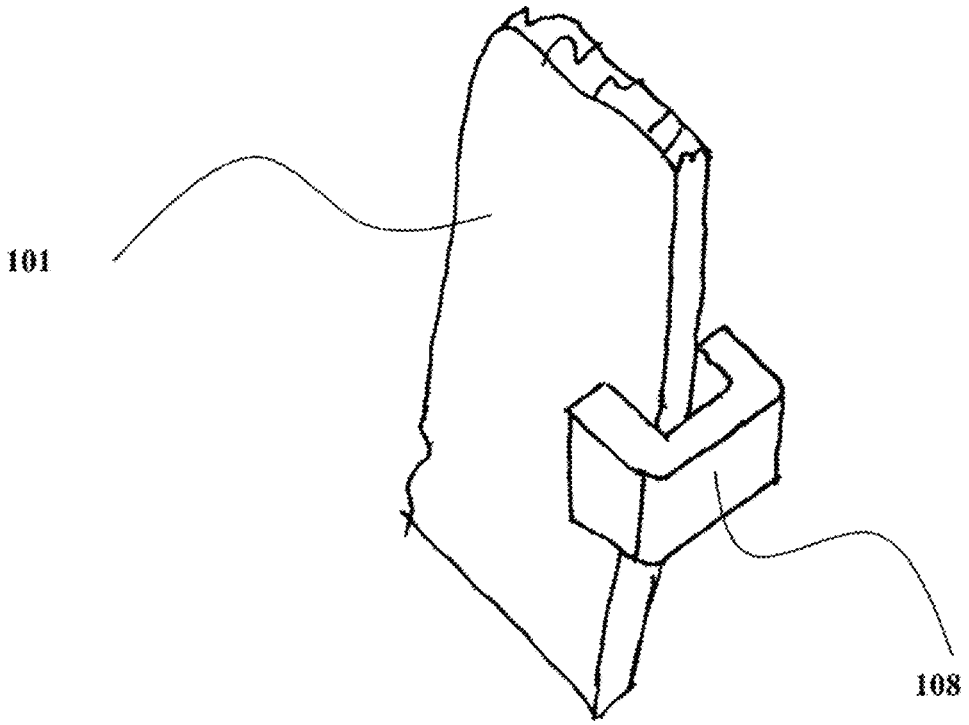
FIG. 35 is a schematic showing a magnified perspective view of a member that limits the movement of the diaphragm.

In certain aspects, the member 108 features two separate structures that wrap around the vertical edge of the diaphragm to limit its movement as shown in FIG. 34. These structures may resemble a U or C-shape when viewed from above as shown in FIG. 35. These structures can be configured so that the open end of the U or C proceeds for any horizontal length down either face of the diaphragm. The structures can also be configured in a variety of heights relative to the vertical edge of the diaphragm. The structures are configured so that a set spacing is maintained between the diaphragm and the inside edges of the structure and the diaphragm does not contact the inside edges of the structure during normal operation of the transducer.

Figure 36:
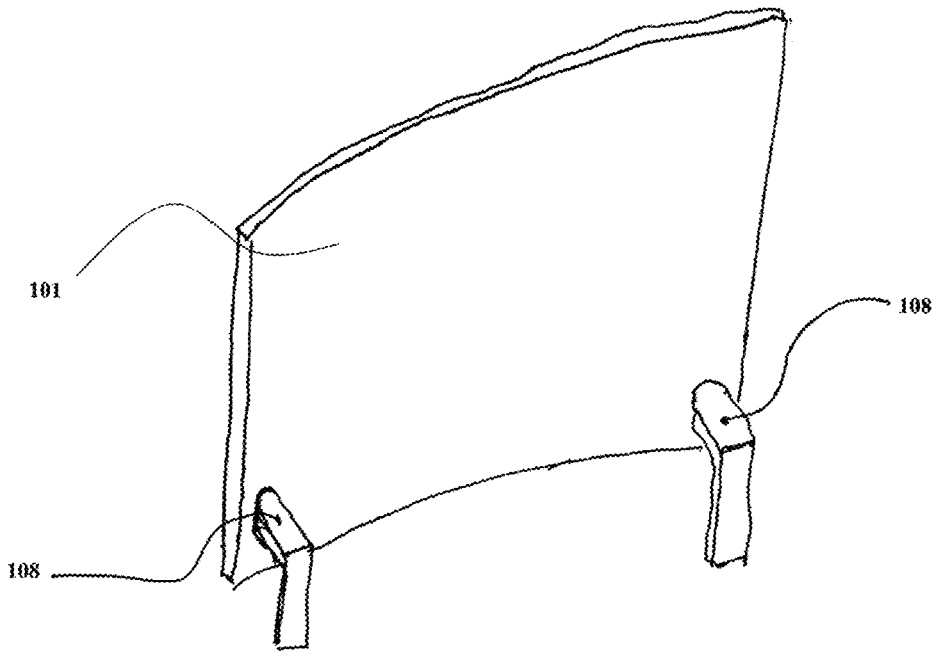
FIG. 36 is a schematic showing a perspective view of another embodiment of a member that limits the movement of the diaphragm.
Figure 37:
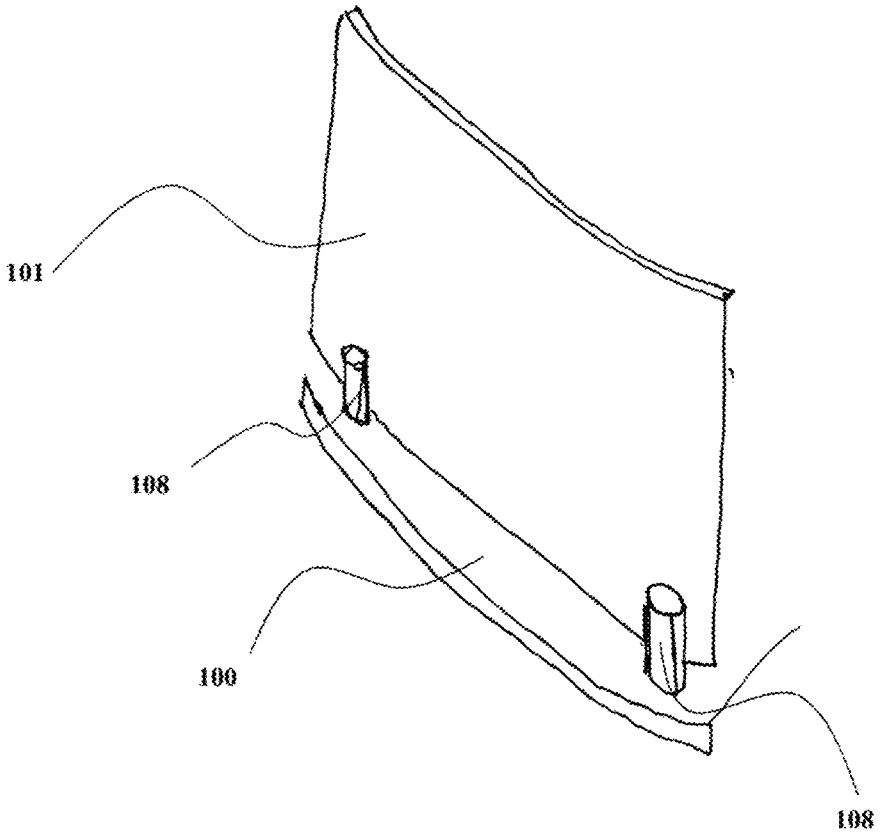
FIG. 37 is a schematic showing a perspective view of another embodiment of a member that limits the movement of the diaphragm.
Figure 38:
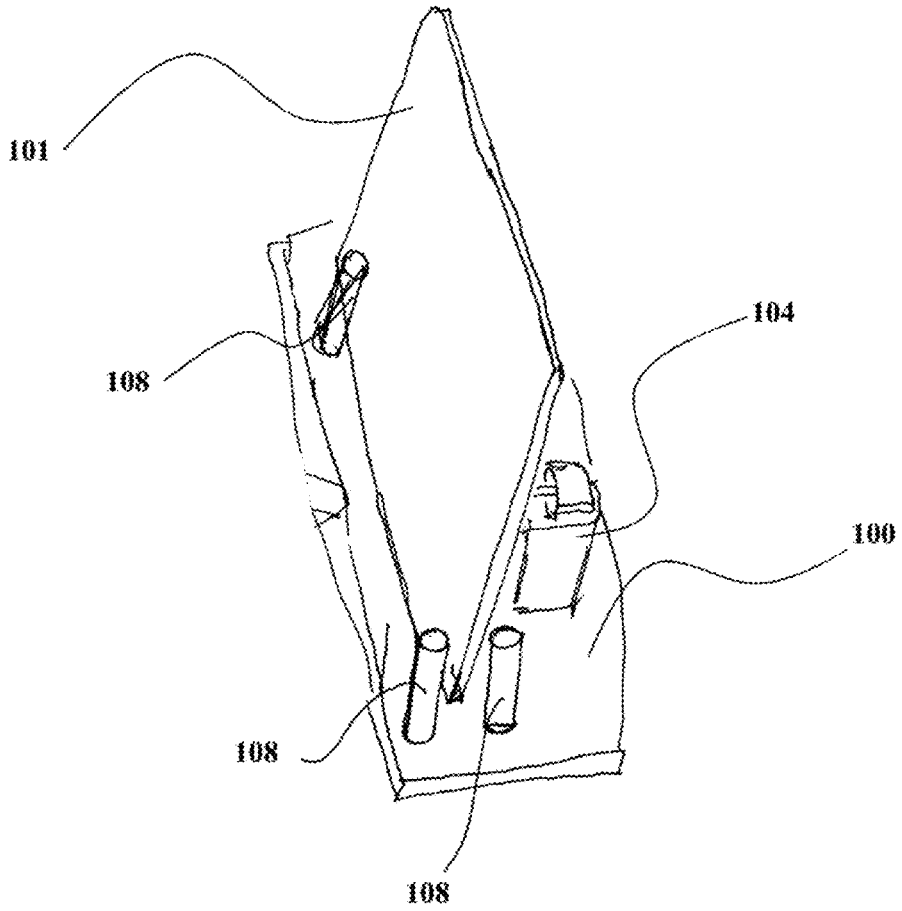
FIG. 38 is a schematic showing a perspective view of another embodiment of a member that limits the movement of the diaphragm.

FIG. 36 shows an alternate embodiment of the transducer with the member 108 consisting of two posts positioned at the rear of the diaphragm and near its vertical edges. FIG. 37 shows a transducer with member 108 consisting of two posts positioned at the front of the diaphragm. The member may also be comprised of four posts with two posts positioned on each planar side of the diaphragm 101 as shown in FIG. 38. These posts can be of various heights and are positioned relative to the diaphragm so that it does not contact the posts during normal operation of the transducer. In certain embodiments, the spacing of the member relative to the diaphragm dictates at what degree the bending of the diaphragm is limited.

The member may act as a mechanical stop at any point or number of points along the diaphragm. One of skill in the art will recognize that the positioning and dimensions of the mechanical stopping member relative to the diaphragm are not limited to specific locations or sizes but will vary depending on the size, shape, material, and operating parameters of the transducer and the diaphragm.

The mechanical stopping member may be coupled to the transducer's base or support in order to maintain a determined spatial relationship to the diaphragm during normal use. Coupling the member to the support also provides support to the member when extreme bending stress is placed on the diaphragm. In certain embodiments, the member is detachably coupled to the support. The coupling may be by any mechanism known in the art, e.g., adhesives, friction, clamp, fasteners, rivets, material connection such as those made by laser welding or ultrasonic welding, or magnetic connection The member can be constructed of any material suitable to resist bending of the diaphragm. Suitable materials for the member include plastic, glass, metal, carbon-fiber composite, rubber, wood, or any combination thereof.

Mechanical stopping members of the invention may be made in a variety of ways. The actual method will depend on, among other things, the configuration of the member and the material from which it is constructed. In certain embodiments, injection molding may be used to form the members in accordance with the invention.

Plastic injection molding is well known in the art. To mass produce the members a mold block with the shape of the member provided as a hollow cavity coupled to a reservoir that can inject molten plastic resin is made. The mold is made in two halves such that a completed part can be removed from one of the halves without any portion being impeded by portions of the mold cavity. Persons skilled in the art are readily familiar with the requirements. The mold is placed in a processing machine capable of clamping the two halves of the mold together with many tons of force. Molten plastic resin is injected into the cavity at very high pressure in order to facilitate rapidly filling thin or distant volumes of the mold. The need for rapid filling is due to the limited time before the molten plastic cools into a solid. Within a cycle time generally less than two minutes the mold may be closed, filled and emptied of completed parts. In order to optimize the cost and throughput of molded parts in the machine the mold may be comprised of several identical cavities. Molds can have 1, 2 or even dozens of cavities and produce a commensurate number of parts in each cycle.

(g) Member to Prevent Edge Impact onto Diaphragm

Figure 18:
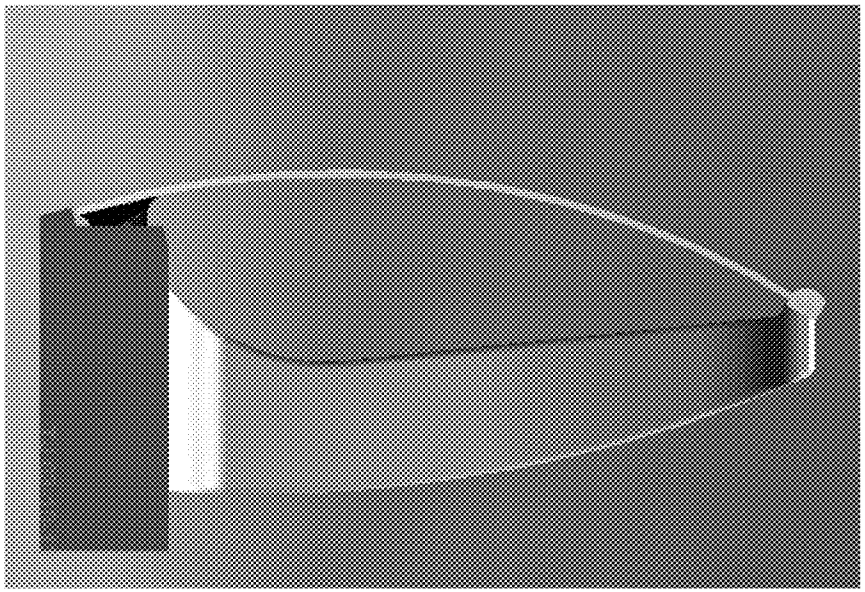
FIG. 18 is a schematic showing a side view of a soundbar of the invention.
Figure 19:
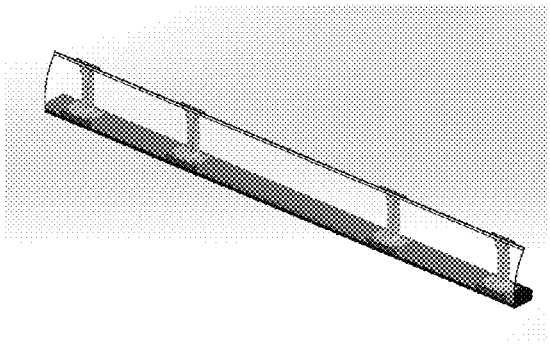
FIG. 19 is a schematic showing a front perspective view of one embodiment of a soundbar of the invention
Figure 20:
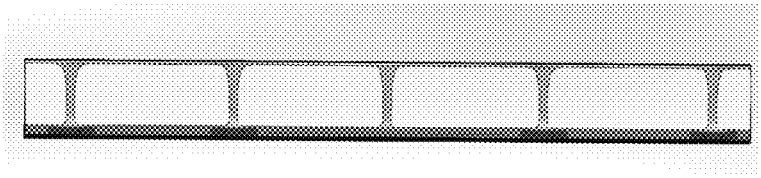
FIG. 20 is a schematic showing a front view of a soundbar of the invention with a center strut.
Figure 21:
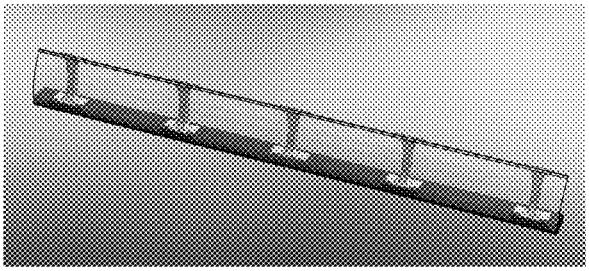
FIG. 21 is a schematic showing a front perspective view of a soundbar of the invention with a center strut.
Figure 22:
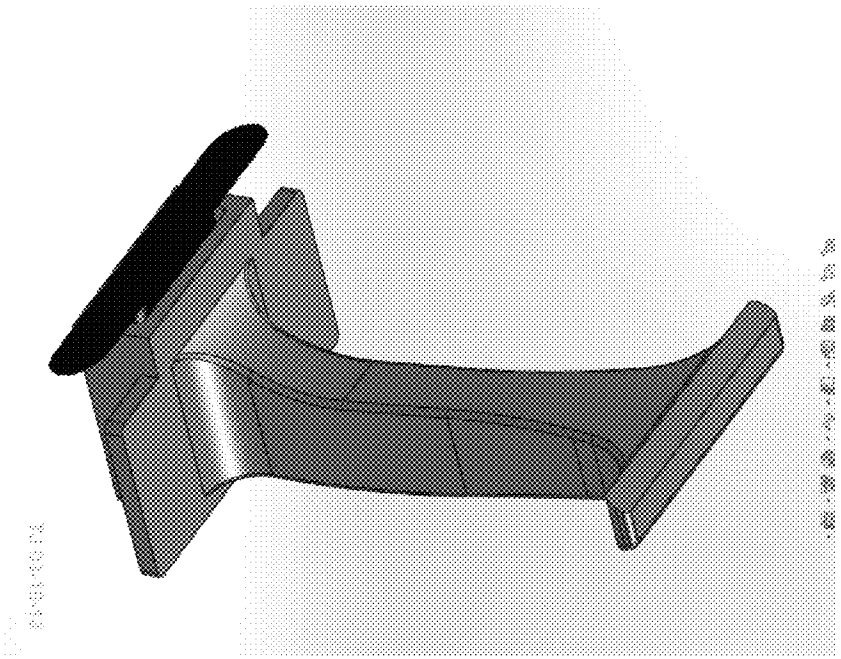
FIG. 22 is a schematic showing a side perspective view of an integrated piezo strut of the invention.
Figure 23:
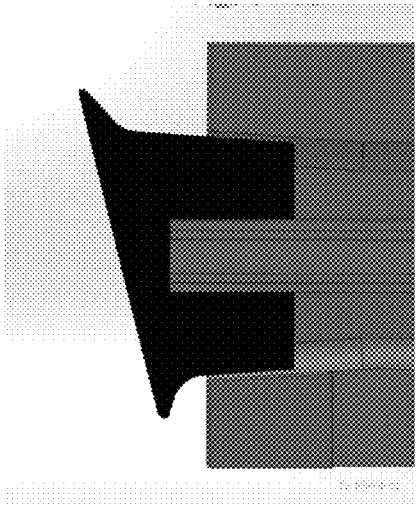
FIG. 23 is a schematic showing a magnified, cutaway, side view of an integrated piezo strut of the invention.
Figure 24:
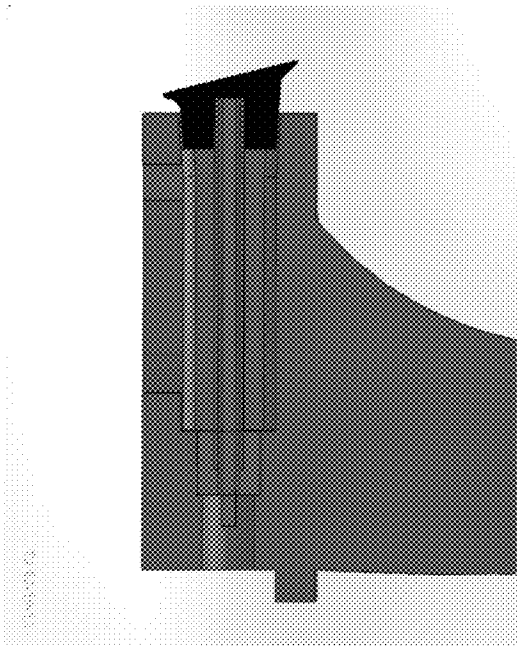
FIG. 24 is a schematic showing a cutaway, side view of an integrated piezo strut of the invention.
Figure 25:
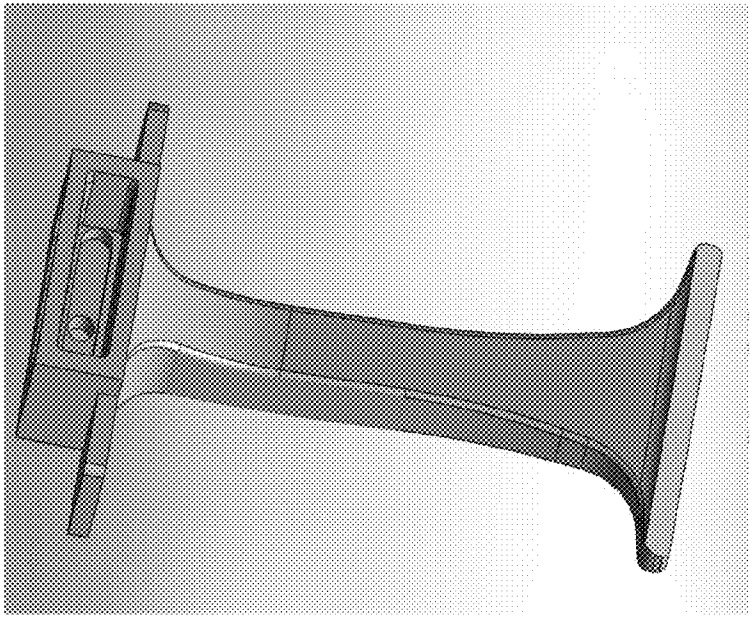
FIG. 25 is a schematic showing front perspective view of an integrated piezo strut of the invention with the strut removed.
Figure 26:
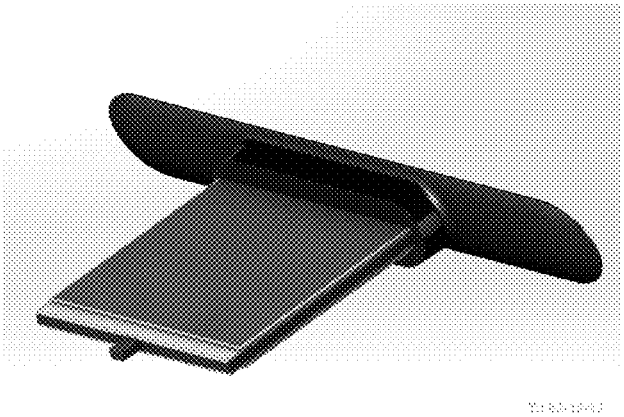
FIG. 26 is a schematic showing a rear perspective view of a piezo strut of the invention.
Figure 27:
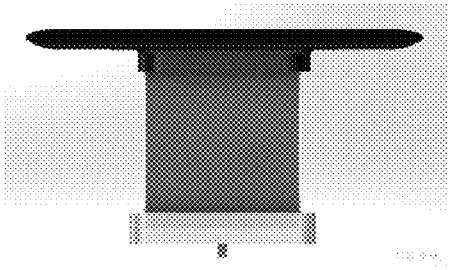
FIG. 27 is a schematic showing a top-down view of a piezo strut of the invention.
Figure 28:
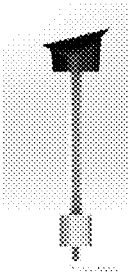
FIG. 28 is a schematic showing a side view of a piezo strut of the invention.

Another durability problem can arise from a direct edge impact onto the diaphragm, in particular in a frameless design. This can create high shear forces onto the interface of diaphragm to actuator or connector that can create damage in the diaphragm or actuator or connector or interface layer. This is a particular problem on the edge or edges of the diaphragm that is attached to the actuator and that is moving as these cannot be protected through firm coupling with a frame. A solution is to introduce a member that physically prevents an edge impact onto one side of the diaphragm. A preferred implementation is shown in FIG. 18 (soundbar). In this implementation the member is part of the base/support and protrudes at least to the height of the diaphragm or beyond and thereby prevents a direct edge impact.

(h) Connector Piece Between Support and Diaphragm

Another area of the diaphragm that can get damaged when dropping the transducer is the connection of the diaphragm to the support. As discussed above a stress concentrator can cause damage to the diaphragm. A solution to this problem is a tapered design of the interconnection point between the diaphragm and the support to achieve a gradual stiffness change. This can be achieved with a tapered connector piece, with a tapered edge that is integral to the diaphragm or with a support that includes a tapered feature. Another solution is the use of a relatively soft and compressible connector piece between the diaphragm and the support. In a preferred implementation the connector piece has a lower modulus than the diaphragm and the support and it is made out of a rubber or silicone. Other materials can be used as well. The relative softness and compressibility of the connector material will allow for a bending of the diaphragm around a larger radius and a reduction of maximum stresses. A soft and compressible connector piece can be combined with a tapered design. A preferred implementation is shown in FIG. 4-7 where the relatively soft connector pieces are indicated with the numbers 110 and 111.

(i) Auxiliary Supports

Figure 16:
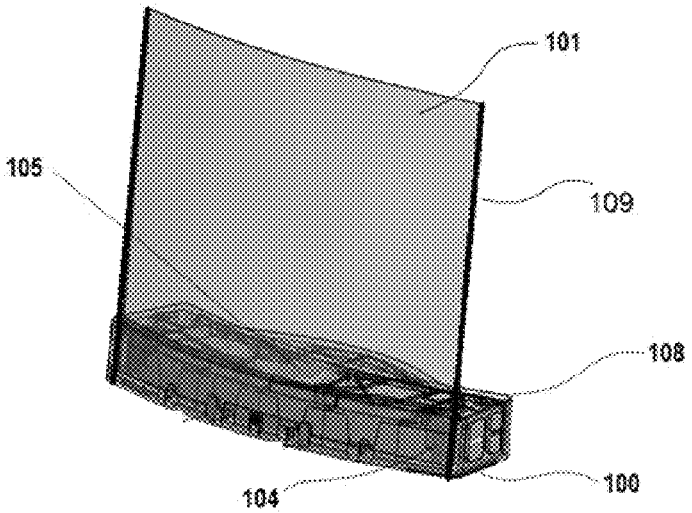
FIG. 16 is a schematic showing a transducer of the invention in which the diaphragm is coupled to two auxiliary supports.
Figure 17:
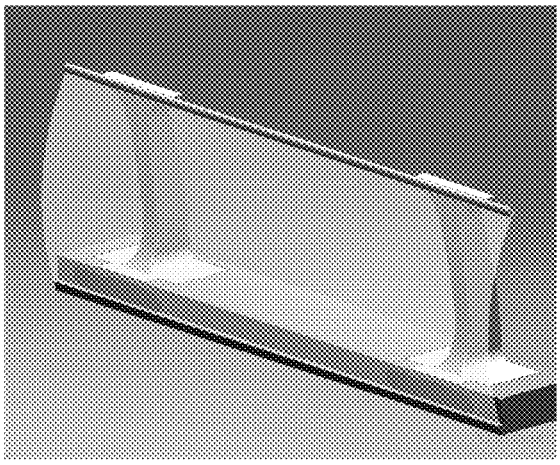
FIG. 17 is a schematic showing a front perspective view of a soundbar of the invention.

In certain embodiments, the transducers of the invention include auxiliary support. FIG. 16 shows an exemplary embodiment of a transducer of the invention having auxiliary supports 109 attached to the left and right sides of the diaphragm. Auxiliary supports 109 are coupled to the support 100. The auxiliary supports provide extra strength to the diaphragm and extra protection if the transducer is bumped or dropped. Typically, the diaphragm will be coupled to only at the top left and top right corners of the auxiliary supports even though the supports run the length of the diaphragm. This embodiment is only exemplary and not limiting in any manner of the use of the auxiliary supports. Numerous other configurations regarding the location of the supports, the number of the supports, and the coupling of the supports to the diaphragm are within the scope of the invention.

In a three sided frameless transducer design such as those shown in FIGS. 1 to 9 the bending of the diaphragm upon impact with a hard object such as in drop on a surface from 120 cm causes high stresses at the connection points. One way to improve the reliability of such a design is to use auxiliary supports on the left and right sides, coupled at the top left and right corner. The function of these supports is to prevent bending of the diaphragm to occur while still permitting the sideways movement of the diaphragm that is required as part of its function as an transducer. This can be achieved by using a coupling piece between the auxiliary support and the diaphragm that allows for some movement in plane yet prevents significant bending out of plane.

Soundbar

The invention also encompasses soundbars, as shown in FIGS. 17-28. The soundbars of the invention operate in the same manner as the transducers described above. That is, a mechanical piezoelectric actuator is coupled to a diaphragm, and movement of the actuator causes movement of the diaphragm in a direction that is transverse to the movement of the actuator. The movement of the diaphragm is amplified relative to the movement of the actuator. As above, the diaphragm may be a curved diaphragm. As shown in FIGS. 17-21, diaphragm is coupled along its top portion to a support and along its bottom portion to two piezoelectric actuators. Those figures are exemplary and other configurations are within the scope of the invention. Additionally, the invention encompasses using more than two actuators.

FIGS. 17-21 show that the support is coupled to two struts. A bottom portion of each strut houses a piezo actuator. The relationship of the actuator to the strut and how the actuator fits within the struts is shown in FIGS. 22-28.

Similar to the transducers described above, soundbars of the invention may optionally include additional features so that the transducers of the invention can better withstand the environment in which they will be used without breaking. Exemplary features that can protect transducers of the invention include: (a) mechanical stop or stops to limit the maximum bending of the actuator; (b) connector piece or pieces with tapered edges; (c) actuator substrate with tapered edges; (d) diaphragm with integrated connector piece with tapered edges; (e) removable and re-attachable diaphragm; (f) mechanical stop to limit bending of diaphragm; (g) member to prevent edge impact onto diaphragm, (h) a connector piece between support and diaphragm; and (i) auxiliary supports on the left and right sides. The preferred implementation for each of these measures is described above. The measures can be used individually or in conjunction to improve the reliability of a mechanically amplified acoustic transducers with piezoelectric actuators.

Similar to above, the soundbars of the invention do not need to include all of the features. For example, soundbars of the invention can be provided with none of the additional features, with one of the additional features, or with all of the additional features. Stated another way, the additional features described herein are optional, and no embodiment of the invention should be interpreted to require any of the additional features. Also, any combination of the features may be used with soundbars of the invention.

Equivalents

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. An acoustic transducer comprising:

a curved diaphragm;

a first actuator operably coupled to a face of the curved diaphragm, near one end of the face;

a second actuator operably coupled to the same face of the curved diaphragm, near an opposite end of the face;

a support; and a member comprising a housing having a curved slot that corresponds to the curved diaphragm and configured to fit over the diaphragm while the diaphragm extends through the slot such that the slot limits bending of the diaphragm but does not contact the diaphragm when the diaphragm is at rest;

wherein movements between the first actuator and the diaphragm and the second actuator and the diaphragm employ mechanical amplification; and wherein the first and second actuators are configured to move simultaneously in opposite directions so that the diaphragm oscillates between a greater and a lesser degree of curvature around a resting degree of curvature.

2. The transducer according to claim 1, wherein the member surrounds the diaphragm.

3. The transducer according to claim 1, wherein the actuator is a piezoelectric actuator.

4. The transducer according to claim 3, wherein the piezoelectric actuator is a bending-type piezoelectric actuator.

5. The transducer according to claim 4, wherein the bending-type piezoelectric actuator is a unimorph, bimorph, or multimorph actuator.

6. The transducer according to claim 1, wherein the diaphragm is composed of a material selected from the group consisting of plastic, metal, paper, carbon-fiber composite, fabric, foam, paper, and a combination thereof.

7. The transducer according to claim 1, wherein the member is coupled to the support.

8. The transducer according to claim 1, wherein the member is removably coupled to the support.

9. The transducer according to claim 1, wherein the member is composed of a material selected from the group consisting of plastic, glass, metal, carbon-fiber composite, rubber, wood, and a combination thereof.

10. The transducer according to claim 1, wherein the member comprises a structure that wraps around a vertical edge of the diaphragm and limits movement of the diaphragm.

11. The transducer of claim 1, wherein a plurality of actuators act upon the diaphragm such that a plurality of audio signals is emitted separately from the diaphragm.

12. The transducer of claim 11, wherein the plurality of audio signals include a right and a left stereo signal.

13. The transducer of claim 11, wherein the plurality of audio signals includes a right, a left, and a center channel.

14. The transducer according to claim 1, wherein the diaphragm is composed of a non-piezo electric material.

* * * * *